US012510334B2

(12) United States Patent
Vabnick et al.

(10) Patent No.: US 12,510,334 B2
(45) Date of Patent: Dec. 30, 2025

(54) SPECIALLY-SHAPED-CHARGES FOR FOCUSING FLUID JETS

(71) Applicant: Federal Bureau of Investigation, Washington, DC (US)

(72) Inventors: Ian B. Vabnick, Fredericksburg, VA (US); Daniel E. McCarthy, La Plata, MD (US); Lee R. Foltz, Indian Head, MD (US)

(73) Assignee: The United States of America as Represented by the Federal Bureau of Investigation, Department of Justice, Washington, DC (US)

( * ) Notice: Subject to any disclaimer, the term of this patent is extended or adjusted under 35 U.S.C. 154(b) by 166 days.

(21) Appl. No.: 18/338,170

(22) Filed: Jun. 20, 2023

(65) Prior Publication Data

US 2025/0146799 A1 May 8, 2025

Related U.S. Application Data

(60) Provisional application No. 63/354,166, filed on Jun. 21, 2022.

(51) Int. Cl.

| | |
|---|---|
| ***F42B 1/024*** | (2006.01) |
| ***F42B 1/028*** | (2006.01) |
| ***F42B 3/22*** | (2006.01) |

(52) U.S. Cl.
CPC ..... *F42B 1/024* (2013.01); *F42B 1/028* (2013.01); *F42B 3/22* (2013.01)

(58) Field of Classification Search
CPC ..... F42B 1/024; F42B 1/028; F42B 1/032; F42B 1/036; F42B 3/22; F42B 33/06; F42B 33/062
USPC ..... 86/50
See application file for complete search history.

(56) References Cited

U.S. PATENT DOCUMENTS

| | | | |
|---|---|---|---|
| 2,491,516 | A | 12/1949 | Piggot et al. |
| 3,100,445 | A | 8/1963 | Poulter |
| 4,046,055 | A | 9/1977 | McDonalds et al. |
| 4,169,403 | A | 10/1979 | Hanson |
| 4,779,511 | A | 10/1988 | Proctor et al. |
| 4,955,939 | A | 9/1990 | Petrousky et al. |

(Continued)

FOREIGN PATENT DOCUMENTS

| | | | |
|---|---|---|---|
| ES | 2083894 | A2 | 4/1996 |
| GB | 2083894 | A2 | 3/1982 |

*Primary Examiner* — Bret Hayes
(74) *Attorney, Agent, or Firm* — Leydig, Voit & Mayer, Ltd.

(57) ABSTRACT

Provided herein are shaped-charges having curved walls to provide better controllable and improved liquid jet parameters. The shaped-charge comprises a container having a plurality of curved walls for containing a liquid. One or more explosive charges are immersed in the liquid and a detonator channel positioned through the container wall to controllably detonate the one or more explosive charges and from a wedge-shaped liquid jet. Multipoint initiation is achieved using a number of initiation points; a location of one or more initiation contact points with the geometrically-shaped explosive charges; and/or an initiation timing of each of the initiation contact points, including simultaneous initiation or a sequence of initiations. Also provided are related methods of forming liquid jets and attendant applications, including target disruption.

18 Claims, 18 Drawing Sheets

(56) References Cited

U.S. PATENT DOCUMENTS

| | | | | |
|---|---|---|---|---|
| 4,957,027 | A | 9/1990 | Cherry | |
| 5,134,921 | A | 8/1992 | Breed et al. | |
| 5,210,368 | A | 5/1993 | Heller, Jr. et al. | |
| 5,230,324 | A | 7/1993 | Van Horssen et al. | |
| 5,460,154 | A | 10/1995 | Mattern et al. | |
| 5,460,155 | A | 10/1995 | Hobbs, II | |
| 5,785,038 | A | 7/1998 | Mattern | |
| 5,792,977 | A | 8/1998 | Chawla | |
| 6,269,725 | B1 | 8/2001 | Cherry | |
| 6,363,828 | B1 * | 4/2002 | Sherlock | F42B 33/06 42/51 |
| 6,386,109 | B1 * | 5/2002 | Brooks | E21B 43/1195 102/306 |
| 6,439,127 | B1 | 8/2002 | Cherry | |
| 6,453,788 | B1 * | 9/2002 | Lebet | F41H 11/12 89/1.13 |
| 6,490,957 | B1 | 12/2002 | Alexander et al. | |
| 6,532,947 | B1 | 3/2003 | Rosa et al. | |
| 6,584,908 | B2 | 7/2003 | Alford | |
| 6,644,166 | B2 | 11/2003 | Alexander et al. | |
| 6,896,204 | B1 * | 5/2005 | Greene | F41B 9/0087 239/289 |
| 7,401,766 | B2 | 7/2008 | Schorloff et al. | |
| 8,091,479 | B1 | 1/2012 | Jakaboski et al. | |
| 8,276,495 | B1 | 10/2012 | Chiu et al. | |
| 8,677,902 | B1 | 3/2014 | Rock et al. | |
| 9,322,624 | B2 | 4/2016 | Alford et al. | |
| 9,322,625 | B1 | 4/2016 | Langner | |
| 9,360,222 | B1 | 6/2016 | Collier | |
| 9,404,718 | B1 | 8/2016 | Shaver et al. | |
| 9,429,408 | B1 | 8/2016 | Chamberlain et al. | |
| 9,453,713 | B1 | 9/2016 | Langner | |
| 9,470,499 | B2 | 10/2016 | Benson | |
| 9,958,245 | B1 | 5/2018 | Shih et al. | |
| 9,976,838 | B1 | 5/2018 | Langner | |
| 10,054,388 | B1 | 8/2018 | Langner | |
| 10,066,916 | B1 | 9/2018 | Vabnick et al. | |
| 10,451,378 | B2 | 10/2019 | Vabnick et al. | |
| 10,495,433 | B1 | 12/2019 | Langner | |
| 10,760,872 | B2 | 9/2020 | Vabnick | |
| 10,794,660 | B2 | 10/2020 | Vabnick | |
| 10,921,089 | B1 | 2/2021 | Vabnick et al. | |
| 11,187,487 | B1 | 11/2021 | Vabnick et al. | |
| 11,262,155 | B2 | 3/2022 | Vabnick | |
| 11,274,908 | B2 | 3/2022 | Vabnick | |
| 11,421,971 | B2 | 8/2022 | Vabnick | |
| 11,796,279 | B1 | 10/2023 | Vabnick et al. | |
| 11,898,830 | B2 | 2/2024 | Vabnick | |
| 11,933,580 | B2 | 3/2024 | Vabnick et al. | |
| 2003/0131749 | A1 | 7/2003 | Lussier | |
| 2005/0081706 | A1 | 4/2005 | Alford | |
| 2006/0163544 | A1 | 7/2006 | Schlorff et al. | |
| 2011/0061521 | A1 | 3/2011 | Gardner et al. | |
| 2018/0259306 | A1 | 9/2018 | Trefilov | |
| 2019/0249944 | A1 | 8/2019 | Vabnick et al. | |
| 2019/0309606 | A1 | 10/2019 | Loehken et al. | |
| 2020/0025508 | A1 | 1/2020 | Vabnick | |
| 2020/0056858 | A1 | 2/2020 | Vabnick | |
| 2020/0173761 | A1 | 6/2020 | Vabnick | |
| 2020/0378736 | A1 * | 12/2020 | Vinci | F42D 1/02 |
| 2021/0041205 | A1 | 2/2021 | Vabnick | |
| 2021/0063125 | A1 * | 3/2021 | Seung | F42B 25/00 |
| 2021/0404777 | A1 | 12/2021 | Vabnick et al. | |
| 2023/0083139 | A1 | 3/2023 | Vabnick | |
| 2024/0068767 | A1 | 2/2024 | Vabnick et al. | |

* cited by examiner

SPECIALLY-SHAPED-CHARGES FOR FOCUSING FLUID JETS

CROSS-REFERENCE TO RELATED APPLICATION

This application claims the benefit of priority to U.S. Provisional Patent Application No. 63/354,166, filed Jun. 21, 2022, which is hereby incorporated by reference in its entirety.

STATEMENT OF GOVERNMENT INTEREST

The inventions described herein were invented by employees of the United States Government and thus, may be manufactured and used by or for the U.S. Government for governmental purposes without the payment of royalties.

BACKGROUND OF INVENTION

Explosively-propelled liquids are used to disrupt explosive devices, including improvised explosive devices (IEDs). One system relies on mass-focusing shaped-charges to propel a liquid fluid on target. See, for example, U.S. Pat. Nos. 10,921,089 and 11,933,580 filed Feb. 8, 2021, and U.S. Pat. Pub. No. 2024/0068767 corresponding to 63/295,347 filed Dec. 30, 2021, each of which are incorporated by reference herein to the extent not inconsistent herewith.

There are several commercial and improvised shaped-charges that drive water and each have their strengths and weaknesses. A common method is to attach the explosives to a plastic former, which is either seated inside the fluid, sandwiched between fluid chambers, or is on the outside surface of the fluid container. Pressure fields are produced by shaping explosives into hemispherical, parabolic, linear (wedge or hemi-cylindrical), rod and conical charge geometries. When the explosives are initiated, shocks form inside the water column and reflect off of the free field surfaces. Various parameters such as angles and corners within the container of fluid or on the explosive former define the pressure-time history of the gases and shocks acting on the water. There are regions of high and low pressure that will differentially accelerate the water to form a jet. High pressure regions are due to a Mach-stem effect which are formed by collisions of shocks, usually along a central axis or plane. A slug of water is the projectile, and water behind the explosives traps the gases, thus increasing the duration of pressure acting on the slug. Shocks can also reflect at the tamper boundaries and move back into the water, amplifying the pressure.

Water and other fluids can be driven explosively using shaped-charges to form liquid jets which move at relatively high velocity and can perform work on a target. Explosives are shaped and immersed in the water or placed on the outside of a water container. The explosives' detonation produces shock waves that move through the water. Typically, to create a jet, the charge is configured such that the shocks along a central axis or a bisecting plane converge and form a Mach stem. The pressure is higher in the center compared to the sides. A pressure gradient results in the water accelerating differentially as its position moves away from the center. The result is a jet that has a velocity profile with faster water at its front and the gradient is such that the water slows as one moves towards the explosive gas products. That velocity profile provides a number of challenges, including jet destabilization, gasification and atomization arising from shock waves in the fluid.

Provided herein are specially shaped-charges and multi-point initiation configurations that provide the ability to further independently control one or more liquid jet parameters relevant for tailoring the shaped-charge to the specific application, such as controlling liquid jet tip velocity, jet cross-sectional shape, integrity, size and the like. This can be important as different targets and operational conditions can be addressed with the shaped-charges provided herein so as to achieve desired outcomes in a safe and reliable manner, including for improvised explosive device (IED) disruption.

SUMMARY OF THE INVENTION

Provided herein are shaped-charges and related methods of using the shaped-charges to produce a liquid jet that can be used to disrupt a target, including a target that is an explosive device, such as an IED. In particular, the devices and methods provided herein address problems with reliably controlling liquid jet parameters depending on the application of interest so as to ensure reliable target disruption without risking uncontrolled target explosion. The problems are addressed by specially shaped container walls with explosive main charge(s) that can be geometrically shaped and controllably positioned in the container, including in various positions, with optional multiple-point initiation so as to minimize unwanted cavitation. Furthermore, the devices and methods are compatible with use of an attenuating material, including any of the SMART materials and related devices as described in U.S. Pat. Pub. No. 2024/0068767 (Published Feb. 29, 2024) titled "SURFACE MATERIAL ATTENUATION OF RAREFACTION SHOCK WAVES TO ENHANCE SHAPED-CHARGES" specifically incorporated by reference herein.

Provided is a shaped-charge comprising: a container having a plurality of curved walls, a top surface, and a bottom surface to form a container volume for containing a liquid, the container having a symmetry plane. One or more explosive charges are configured to be positioned in the container volume, including an at least partially liquid-filled container volume or an entirely liquid-filled container volume. A detonator channel is positioned at least through one surface of the container to receive a detonator or detonating cord to controllably detonate the one or more explosive charges. For example, the detonator channel may traverse the container top surface. The container walls, explosive charges and liquid are configured to provide a wedge-shaped liquid jet upon detonation of the one or more explosive charges immersed in the liquid contained in the container volume.

The shaped-charges are compatible with any of a range of wall curvatures, including walls that are themselves curved or that effectively are curved through positioning of another component between the liquid and container that effectively makes the wall curved. In an embodiment, the walls are described as having a catenary or parabolic profile.

The parabolic profile may extend from the bottom surface to the top surface, wherein the parabolic profile is uniform along an axial direction extending from the bottom surface to the top surface. Alternatively, the parabolic profile is a biaxial profile having a parabolic curvature along each of an axial direction and a radial direction relative to a container center-line.

The shaped-charge may comprise a distal surface, a proximal surface, a first sidewall, and a second sidewall, wherein the first and second sidewalls are opposed surfaces that connect the distal and proximal surfaces to form the container volume. The bottom surface may comprise at least a flat portion to facilitate positioning on a surface, with the distal surface facing the target. In this manner, upon detonation of explosive charge(s), liquid is configured to jet out of the distal surface toward the target.

The first and second sidewalls may have a curvature that is different from a curvature of the distal and proximal surfaces. Alternatively, all curvatures are matching. Alternatively, the first and second walls have matching curvatures, and the proximal and distal surfaces have matching curvatures. Preferably, the curvature is described generally as concave with respect to an individual looking at the container from outside the container volume (observing the outer surfaces of the container).

The shaped-charge may further comprise an apex region positioned between adjacent curved walls, wherein the apex region has a different geometrical shape than the curved walls.

The shaped-charge may further comprise a passage in the top surface configured to provide filling of the container volume with the liquid; and a lid to fluidically seal the liquid in the container volume. For example, the lid and passage may be threaded to facilitate easy open and closing by rotation of the lid relative to the top surface passage.

Also provided herein are one or more specially configured and/or positioned explosive charges that are used to propel water from the inside the container in a liquid jet toward a target. In an embodiment, one explosive charge is used. In an embodiment, two explosive charges are used. In an embodiment, three or greater than three explosive charges are used. In an embodiment, any or all of the explosive charges are geometrically-shaped-charges.

The shaped-charges are compatible with any of a range of geometrically-shaped-charges. Geometry, number, and relative positions can be selected depending on desired jet parameter. The desired jet parameter, depends in turn on the particulars of the target (e.g., size, type, composition) and operational conditions (e.g., stand-off distance, intervening obstacles such as a vehicle surface). A disrupter containing one explosive charge has a much wider jet shape and has a higher impulse and less penetration than a disrupter containing two or more explosive charges.

The geometrically-shaped-charge may have a volume defined by a cuboidal shape, a cylindrical shape, a pyramidal, a rhombus shape, an ellipsoid shape, a shelled surface that is planar or curved, or comprised of multiple planar or curved surfaces angled relative to each other. "Shelled surface", in this context, refers to a curved or planar surface that can support an explosive charge. The explosive charge may be described as having an outer surface that may be straight-lined or an outer surface that is bent at a defined angle.

The geometrically-shaped-charge may have a central position region and a charge length, wherein the central position region corresponds to up to 40% of the charge length and contains up to 50% of total explosive volume. In this manner, additional control of explosive intensity, including a spatially-varying intensity, is provided within the container volume.

The geometrically-shaped-charge can be described as extending between a first end and a second end, wherein the geometrically-shaped-charge has an axial-dependent cross-sectional area that decreases from a center point toward each of the first end and the second end.

The one or more explosive charges can be formed into a high-density explosive charge that has a density that is at least 20% higher than an equivalent hand-packed explosive charge. This can be achieved by sectioning from a machine press extruded M112 block or a commercially extruded composition C-4 block.

Any of the shaped-charges described herein may further comprise an explosives holder configured to hold at least two explosive charges and controllably position the explosive charges in the container volume for multi-point initiation.

Optionally, the controllably positioned may be one or both of a longitudinal positioner (e.g., control the separation distance from the distal container wall) and a lateral positioner (e.g., control the separation distance between adjacent explosive charges and/or control the separation distance from the center-line axis or a sidewall of the container). In this manner, the explosives holder is configured to variably position the explosive charges in a longitudinal position and/or a lateral position within the container volume to provide a controllable frontal distance to the container distal surface and/or a lateral distance to the container side wall surface.

The shaped-charge may be supported by and contained within an explosive holder. Accordingly, the shaped-charge may further comprise the explosive holder, wherein the explosive holder supports and positions the geometrically-shaped-charges. The explosive holder may also support, position and orient an explosive firing train, including to provide a controlled contact point or contact area between the initiator (e.g., a blasting cap) and the geometrically-shaped-charge(s) for desired detonation of the geometrically-shaped-charge(s). For example, the explosive holder may position the explosive firing train such that there is a multi-point detonation of the geometrically-shaped-charge (s). For example, Primasheet® sheet explosives may be the explosive firing train that is positioned in an explosive guide of the explosive holder to contact with the shaped-charges at desired locations. Alternatively, the explosive firing train may comprise detonation cord or other explosives. The explosives guide can define an explosives path between the initiator (blasting cap) to the geometrically-shaped-charge for simultaneous initiation of each of the geometrically-shaped-charges. In this aspect, the explosive holder is generally multi-functional, providing support and positioning of each of the shaped-charge(s) and the explosives of the explosive firing train. The explosive holder, including the explosive guide, is compatible with any of a range of planar (e.g., 2-D) or out-of-plane (e.g., 3-D) geometries. An out-of-plane geometry provides yet another variable that can be controlled to further control direction of detonation wave propagation, velocity, transition to steady state, and pressure amplitude in the shaped-charge(s). The flexible sheet explosives (e.g., the explosive firing train such as Primasheet® flexible sheet explosives) may be in-plane, or may have at least a portion that is out-of-plane, such a curved geometry relative to a plane. The explosives guide is part of the fuzing system that supports both the shaped charges and an explosive firing train that is the connecting explosives from the blasting cap (e.g., initiator) to the main geometrical shape-charge(s) that explosively drives liquid out of the container toward target. The explosive firing train may comprise flexible sheet explosives, such as Primasheet®, and can comprise an explosive type that is different from the explosive composition of geometrically-shaped-charges. Of course, the explosive firing train explosives that propagates the shock stimulus from the blasting cap to the main shaped-charge(s) may have an explosives composition that is similar or equivalent to the shaped-charge composition. The explosives guide transmits the shock from the blasting cap via detonation waves which transfer the shock stimulus to initiate the geometrically shaped-charges. An explosives guide may also be structured to initiate a disrupter containing only one geometrically-shaped-charge or to initiate a singular geometrically-shaped-charge simultaneously at multiple locations.

The explosives holder may comprise branches that form multiple distinct contact points, including contact points that are actually a contact region, with the one or more geometrically-shaped-charges. The multiple distinct points or regions can be used to facilitate collision of multiple detonation waves within the explosives to amplify explosive pressures at convergence regions, including points and planes depending on the specific geometry. The multiple contacts may be simultaneously initiated. Of course, the branches may be configured to have different lengths, so that the shaped-charges provided herein can be compatible with a timed sequence of initiation at multiple distinct contact points or regions.

A position of each of the multiple distinct contact points may be selected to control a liquid jet parameter based on one or more target characteristics, including a liquid jet parameter that is a liquid jet shape, a liquid jet velocity, a liquid jet volume or mass, or a stand-off distance from a target.

The contact points for the same explosive guide geometry may be positioned on different surfaces of the explosives charges. For example the inside surface of the charge(s) or the proximal surface of the charges. Further, the angle(s) of incidence of the explosives bridge/guide relative to the surface at the contact point can also controllably effect the detonation wave formation and propagation. This will also affect the way the gases produced by the guide interact with the liquid and the shock coupling with the liquid. CTH hydrocode modeling has shown up to a 30% increase in the jet tip velocity if the contact point is on the proximal charge surface versus the point of initiation on the inside surface of the charge. Changing the angle of incidence can also dramatically effect jet tip velocity, density, and stability. A normal angle of incidence generates higher velocity jets but usually at the cost of a larger vapor bubble and jet instability.

The geometrically-shaped-charges may comprise sheet explosives wrapped around a tubular cylinder shell having a central orifice filled with water or a rigid rod of a plastic or a high impedance material, optionally steel, copper, brass or aluminum. Preferably, a tubular cylinder shell formed of steel is used. For example, one or multiple wraps of C-2 thickness Primasheet® can be used to change the net explosive weight.

The shaped-charge may comprise multiple shock tube instant detonators, including Nonel® instant detonators, positioned in contact with the geometrically-shaped-charges and configured for simultaneous initiation of the geometrically-shaped-charges. Nonel® instant detonators can have shocktube leads and have no time delay inside of them. The isochronicity of these detonators is in the microsecond time scale. Electric detonators have too much jitter (variability) in their breakout times. The breakout time is the time from stimulus to the time the detonation wave blows out the bottom of the detonator. Alternatively, detonation cord can be used to branch and simultaneously initiate the explosive charges.

The shaped-charges provided herein, and any of the related methods, may be further characterized in terms of the resultant fluid (e.g., liquid) jet. For example, the resultant wedge-shaped fluid jet may be characterized as having a jet length that is at least 1.5 times longer than an equivalent shaped-charge without the plurality of curved container surfaces. This is one manner of characterizing the benefit of using the instantly claimed curved surfaces. The wedge-shaped fluid jet may have a jet height corresponding to a height of the fluid container volume, including for a jet height selected from a range of 3 inches to 3 feet. In this manner, target height may be matched to container height, corresponding to the separation distance between the container bottom and top surfaces.

The shaped-charge may use liquid that is water or that is a HEET (highly efficient energy transfer) liquid, including any of the HEET liquids described in U.S. Pat. No. 11,187,487 issued to Vabnick et al., which is specifically incorporated by reference herein.

The shaped-charge may be described as having a shape charge characteristic size, such as a diameter, wherein the effective stand-off distance from a target is greater than or equal to two times the characteristic size. This aspect reflects the instant shaped-charges are effective at much larger stand-off distances when compared to conventional shaped-charges that do not have the instant wall curvatures that typically have reliable stand-off distance for target disruption that is about one charge diameter.

The shaped-charges and related methods provided herein are compatible with a SMART material. See, e.g., U.S. Pat. Pub. No. 2024/0068767 by Vabnick et al. for the SMART material, including for any of the attenuating bodies described therein used with shape-charge containers, which is specifically incorporated by reference herein.

Any of the shaped-charges may further comprising a SMART material positioned on one or more outer surface of the container, including any portions thereof, or entire surfaces.

In an embodiment, the shaped-charge has at least one of the curved walls that is formed by an insert having a curvature positioned against an inner surface of the container, wherein the insert is selected from the group consisting of: a bladder; a SMART material; a shaped rigid material such that the liquid in contact with the insert has a curved surface. In this manner, the container itself may have flat walls, but another component is used adjacent to the wall, that together form a curved wall.

In an embodiment, the container curved walls comprises a SMART material.

Also provided herein are various methods related to the shaped-charge, including methods for producing a liquid jet and methods of using any of the shaped-charges to disrupt a target.

In an aspect, provided is a method for producing a liquid jet comprising the steps of: providing a container having a plurality of shaped surfaces, including a distal surface, a proximal surface, and one or more side wall surfaces, that together from a container volume having a symmetry plane. For example, the container may be 6-sided, with four side surfaces and a top and bottom surfaces. One of the side surfaces may be the distal surface that faces a target, separated by a proximal surface that is furthest from the distal surface. Two side surfaces connect ends of the distal and proximal surfaces. Alternatively, there may be a single curved side wall surface that connects the proximal and distal surface, thereby forming an axisymmetric container, such as a generally hour-glass shape. In this geometry, the liquid jet has a circular profile that tapers. One or more geometrically-shaped explosive charges are inserted in the container volume. The container volume is filled with a liquid, including before and/or after insertion of the charges, so long as the explosive charges are immersed in the liquid.

The distal surface is aligned with a target, so that the resultant liquid jet will hit the desired target. The one or more geometrically-shaped explosive charges are detonated to produce the liquid jet. In this manner, the liquid jet comprises a wedge-shaped distal end that moves in a direction from the shaped-charge toward a target.

The explosive shaped-charges may be in a fixed position, particularly for scenarios where the optimum position to produce maximum liquid jet density and velocity are known.

In another embodiment where tailored positioning of explosive charges is desired, the method may further comprise the steps of positioning two or three geometrically-shaped explosive charges in an adjustable explosive charges holder; inserting the adjustable explosive charges holder holding the two or three geometrically-shaped explosives in the container volume; and adjusting with the adjustable explosives charges holder to controllably position the geometrically-shaped explosives charges with respect to a separation distance from the distal wall and/or distal surface. This provides another independent means to control a liquid jet parameter. A single explosive charge may also be placed in a holder that is adjustable distally, which can be used to position the charge centrally or toward/away from the distal most surface of the container.

The method may further comprising the step of adjusting one or more of: a curvature of at least one of the plurality of shaped surfaces; a position of an explosive charge in the container volume; a number of the explosives charges; a SMART material positioned on an outer surface of the container; an air gap in the container volume; and/or a liquid composition; to thereby control a fluid (e.g., a liquid) jet characteristic.

The method may further comprise the step of adjusting a multipoint initiation parameter of the one or more geometrically-shaped explosive charges to control a liquid jet parameter, including a cross-sectional shape and/or a jet tip velocity of the liquid jet. For example, the multipoint initiation parameter may be one or more of: a number of initiation points; a location of one or more initiation contact points with the geometrically-shaped explosive charges; and/or an initiation timing of each of the initiation contact points, including simultaneous initiation or a sequence of initiations. The contact points for the same explosive guide geometry may be positioned on different surfaces of the explosives charges. For example the inside surface of the charge(s) or the proximal surface of the charges. Further, the angle of incidence of the explosives bridge/guide relative to the surface at the contact point can also controllably effect the detonation wave formation and propagation. This will also affect the way the gases produced by the guide interact with the liquid and the shock coupling with the water. CTH hydrocode modeling has shown up to a 30% increase in the jet tip velocity if the contact point is on the proximal charge surface versus the point of initiation on the inside surface of the charge. Changing the angle of incidence can also dramatically effect jet tip velocity, density, and stability. The angle of incidence for example measured from the charge vertical axis may be 10, 20, 30, 45, 60, or 90 degrees. A normal angle of incidence generates higher velocity jets but usually at the cost of a larger vapor bubble and jet instability. Accordingly, the method may further comprise adjusting or selecting the position and area of contact between the detonator explosives and the main explosive shaped-charges to further independently control a liquid jet parameter. Similarly, the method may also comprise adjusting or selecting the angle of incidence as described above to independently control a liquid jet parameter.

The method may further comprise the step of geometrically scaling the container by a factor, including a factor of between 1.3 to 20 times, to achieve a liquid jet matched to a target, thereby configuring the liquid jet to penetrate both sides of the target and cause volumetric damage of the target, thereby neutralizing the target.

The method may further comprising the step of translationally scaling the container by a factor, including between 1.3 times to achieve a liquid jet matched to a target, including a liquid jet having a characteristic dimension, such as a surface area, a width or height, an effective diameter, that matches a target characteristic, including a target surface area, a target volume, and/or a target mass.

The method may further comprise the step of adjusting the curvature of one or more container shaped surface to controllably adjust a liquid jet parameter, including a jet stretch rate, a jet tip velocity and a jet profile.

Without wishing to be bound by any particular theory, there may be discussion herein of beliefs or understandings of underlying principles relating to the devices and methods disclosed herein. It is recognized that regardless of the ultimate correctness of any mechanistic explanation or hypothesis, an embodiment of the invention can nonetheless be operative and useful.

DETAILED DESCRIPTION

Figure 1A:
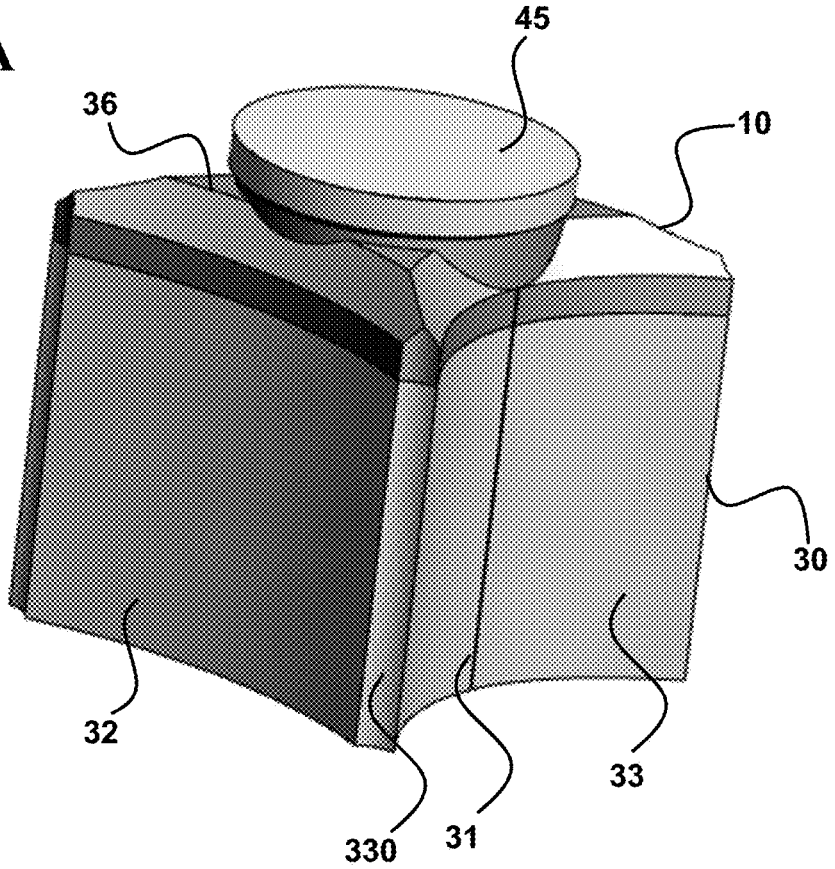
FIG. 1A-1B is a perspective view of a container of the shaped-charge having a plurality of curved walls, with a top surface that has a lid (see top panel-FIG. 1A) and a flat bottom surface (see bottom panel-FIG. 1B). The curved walls are characterized as having one-axis curvature in that the curvature is constant with respect to distance from the flat bottom surface.

In the following description, numerous specific details of the devices, device components and methods of the present invention are set forth in order to provide a thorough explanation of the precise nature of the invention. It will be apparent, however, to those of skill in the art that the invention can be practiced without these specific details.

In general, the terms and phrases used herein have their art-recognized meaning, which can be found by reference to standard texts, journal references and contexts known to those skilled in the art. The following definitions are provided to clarify their specific use in the context of the invention.

"Fluid" refers to a liquid-based material that is contained in the interior volume of the container and that immerses the explosive charges. The shaped-charges are compatible with any number of liquids, including water and high-density liquids, such as corn syrup. As described herein and at U.S. Pat. No. 11,187,487, the fluid may be a high energy efficient (HEET) fluid. The fluid may comprise solid particles suspended in a liquid medium.

"Curved walls" refers to a non-planer surface. The actual curvature can be selected based on the application of interest, and more specifically the desired jet characteristics. A liquid "jet parameter" is used to characterize a liquid jet. Examples of liquid jet parameters including, but are not limited to, jet tip velocity, jet mass, jet volume, jet density, stand-off distance from a target, jet shape, including jet length, jet cross-sectional shape, and the like.

"Attenuating body" refers to one or more layers of material that are connected to the shaped-charge to provide desired control of the fluid or solid jet generated upon detonation of the explosives associated with the shell or liner. That attenuating body is also referred herein as "SMART". The attenuating body may correspond to a liner that is configured to be positioned on another surface. In this aspect "connected" refers to an attenuating body that is connected to the shaped-charge in a manner that the functionality of the components of the shaped-charge is maintained. For example, an attenuating body connected to a container wall does not impact the ability of the wall to contain the liquid. The connection may be direct or indirect. For example, there may be an adhesive applied to adhesively connect the attenuating body to a surface. There may be an intervening attenuating body, such as a liner or an attenuating body layer, between a surface of the shaped-charge and an attenuating body. This is also described herein as an attenuating body multilayer configuration. One function of the attenuating body is to functionally adjust a wall surface thickness so as to impact reflected shock waves that are propagated in the contained liquid and interact with liquid/wall interfaces. The thickness of the attenuating body is selected to achieve the desired fluid jet outcome and, as explained, depends on various parameters. Exemplary thicknesses include ranges between 0.03" and 1". The thickness of an attenuating body may be spatially constant or spatially vary. A spatially-varying attenuating body thickness is also referred herein as a "contoured" attenuating body. The attenuating body may be conformable to a surface. In this manner, the attenuating body has a flexibility such that it can deform and conform to a surface, including a curved surface or a sharp-edged surface. The container material can be the attenuating body and thus the container thickness can be varied and contoured at various locations to provide improved jet characteristics. The container may also have a bisecting symmetry plane.

The attenuating body may correspond to a foam. "Foam" refers to a material that is formed by trapping pockets of gas in a liquid or a solid. A solid foam can be closed-cell or open-cell, depending on whether the pockets are completely surrounded by the solid material. In an open-cell foam, gas pockets connect to each other, including via pores. In a closed-cell, gas pockets are not connected to each other. The foam is polydisperse and is characterized as not uniform and stochastic. Foams efficiently attenuate shockwaves because of the heterogeneous structure in combination with low bulk density. In this manner, pressure waves are broken up and dispersed, thereby providing good shock tamping. Depending on the application of interest, which influences the desired liquid jet characteristics, the foam can be made from any of a range of materials, such as plastic, rubber (natural or synthetic), aluminum or other metals. For example, blasting cap protectors are made from aluminum foam because an aluminum foam absorbs the shock. The attenuating body may also be an aerogel. "Aerogel" refers to a synthetic porous material derived from a gel, where the liquid component has been replaced with a gas without significant collapse of the gel structure. Exemplary aerogels include, but are not limited to, solid smoke, solid air, solid cloud, blue smoke, silica aerogels, carbon aerogels, polymer-based aerogels, metal-oxide aerogels, and the like.

"Focusing" refers to the ability to force liquid in a desired direction with desired properties related to jet formation, stability, and impact pressure or force against a target, including post-barrier penetration.

The term "substantially matched" refers to two components that are similar. In the context of a geometric shape, it refers to a deviation from absolute correspondence that does not adversely impact functional properties associated with the fluid jet and target disruption. The term is intended to reflect that the shaped-charges provided herein are able to tolerate differences between surfaces (e.g., plastic shell surface and cylindrical plastic body distal end) without significant degradation in a liquid jet parameter. As desired, the term may be optionally quantitatively defined, such as curve parameters that differ by less than 10% from each other, such as curvature, distances, and any parameters associated with a corresponding curve fit, such as:

$$y = \frac{e^{ax} + e^{-ax}}{2a} = \frac{\cosh ax}{a}$$

where the parameter "a" is within 10% for each of the two best-fit curves (with surface then formed as a rotation of the function about the central longitudinal axis). In a similar manner, best-fitting of any of the curves or corresponding surfaces may be performed to define whether two surfaces are substantially matched.

Unless otherwise defined, "approximately" or "substantially" refers to a value that is within 10% of a desired or true value, and can correspondingly include identically matched.

"Proximal" and "distal" are relative to the detonator and target. A distal position is further from the detonator and closer to the target than a proximal position. The terms are useful in describing relative positions of components.

The terms "central longitudinal axis" and "bisecting symmetry plane" are used to refer to relative positions with respect to the shaped-charge and associated target. In general, a longitudinal axis corresponds to the notional line leading from the shaped-charge toward a target, and is relevant for shells that have a container volume for containing an explosive. A "bisecting symmetry plane" is generally relevant for a shell having a surface to support a surface-conforming explosive. For desired fluid jet characteristics, the surface has a plane of symmetry, referred herein as a bisecting symmetry plane, where the distal shell surface faces toward the target through the container distal end.

The invention can be further understood by the following non-limiting examples.

Example 1: FLExCAT Container Overview

Figure 1B:
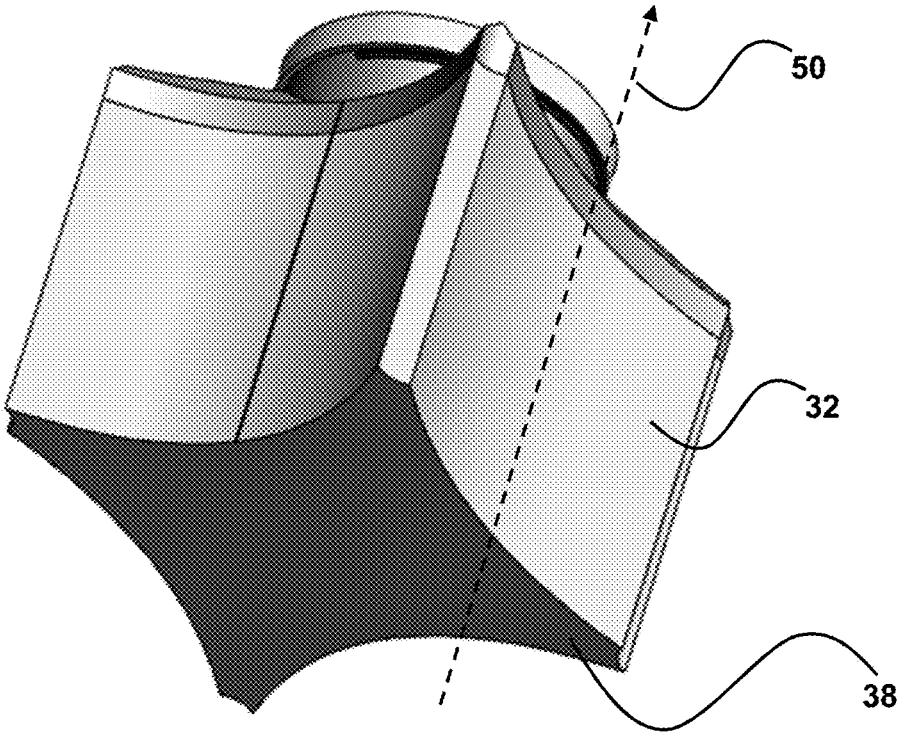
Figure 2A:
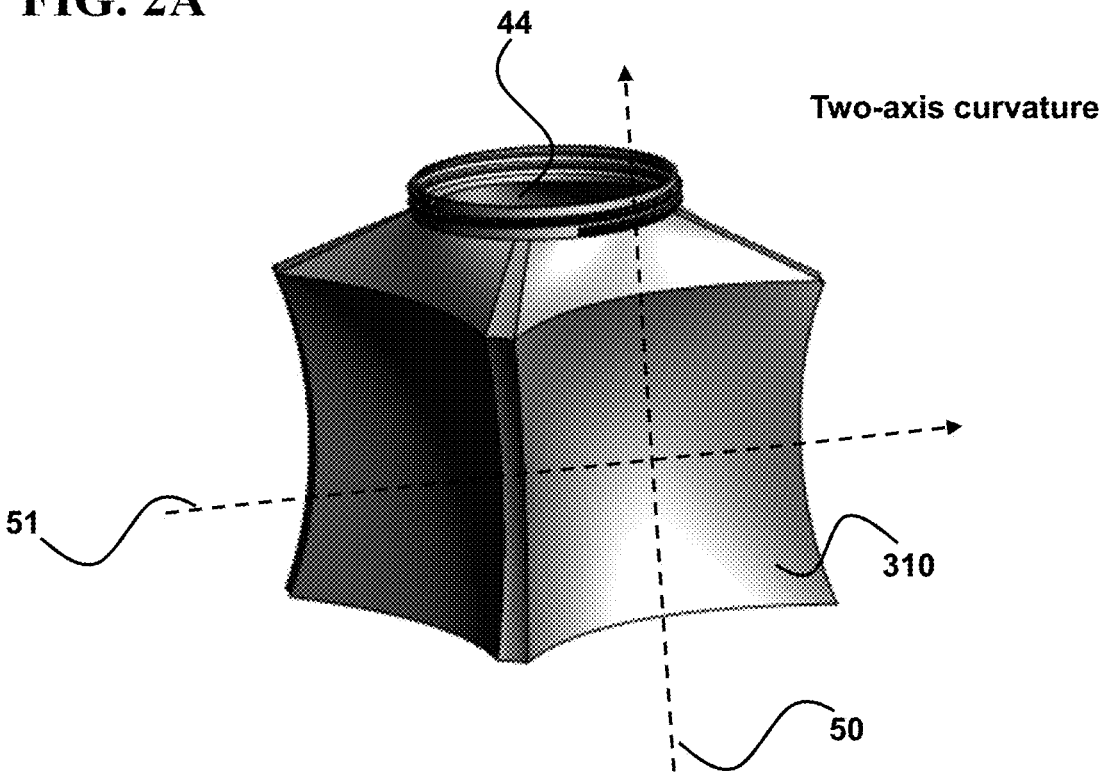
FIG. 2A-2B is similar to FIG. 1A-1B, but with the curvature that varies in two-axis, referred herein as two-axis curvature. There is curvature with respect to each of two-axis, one running from the bottom to top surface, in addition to the curvature axis of FIG. 1A-1B.
Figure 2B:
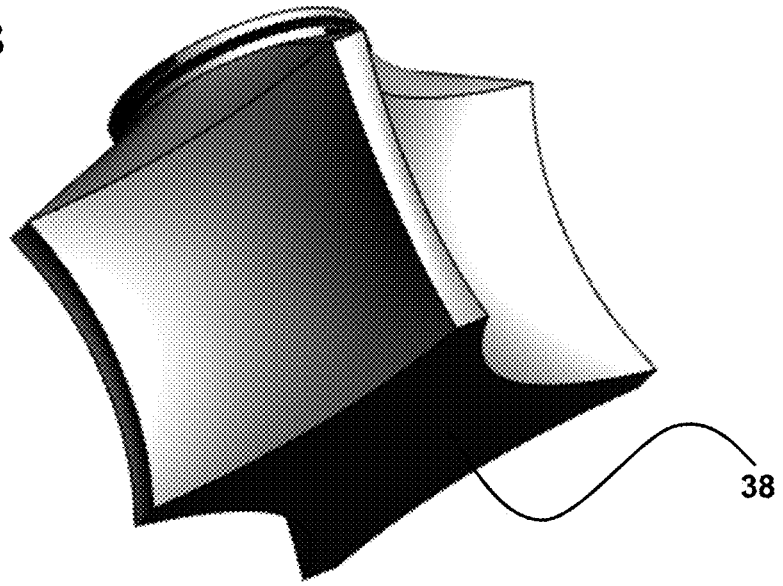
Figure 3A:
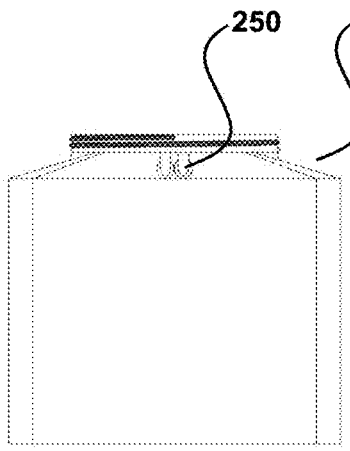
FIG. 3A-3C is a side view (FIG. 3A), top view toward the side with the lid removed (FIG. 3B), and cross-sectional view (FIG. 3C) through the indicated plane of FIG. 3B to illustrate an explosives holder comprising two stems and an explosives bridge, also referred herein as the explosive guide, that supports the explosive firing train for controlled detonation of the main explosive(s) shaped-charge(s), that can be positioned within the container volume.
Figure 3B:
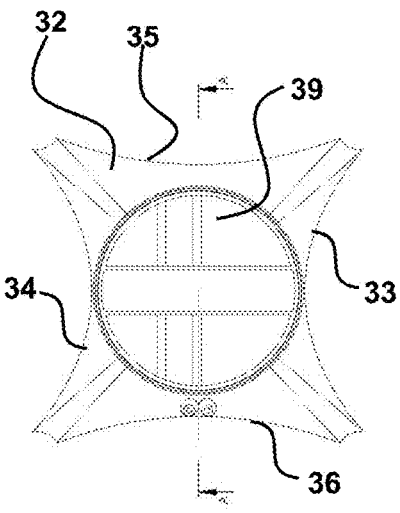
Figure 7:
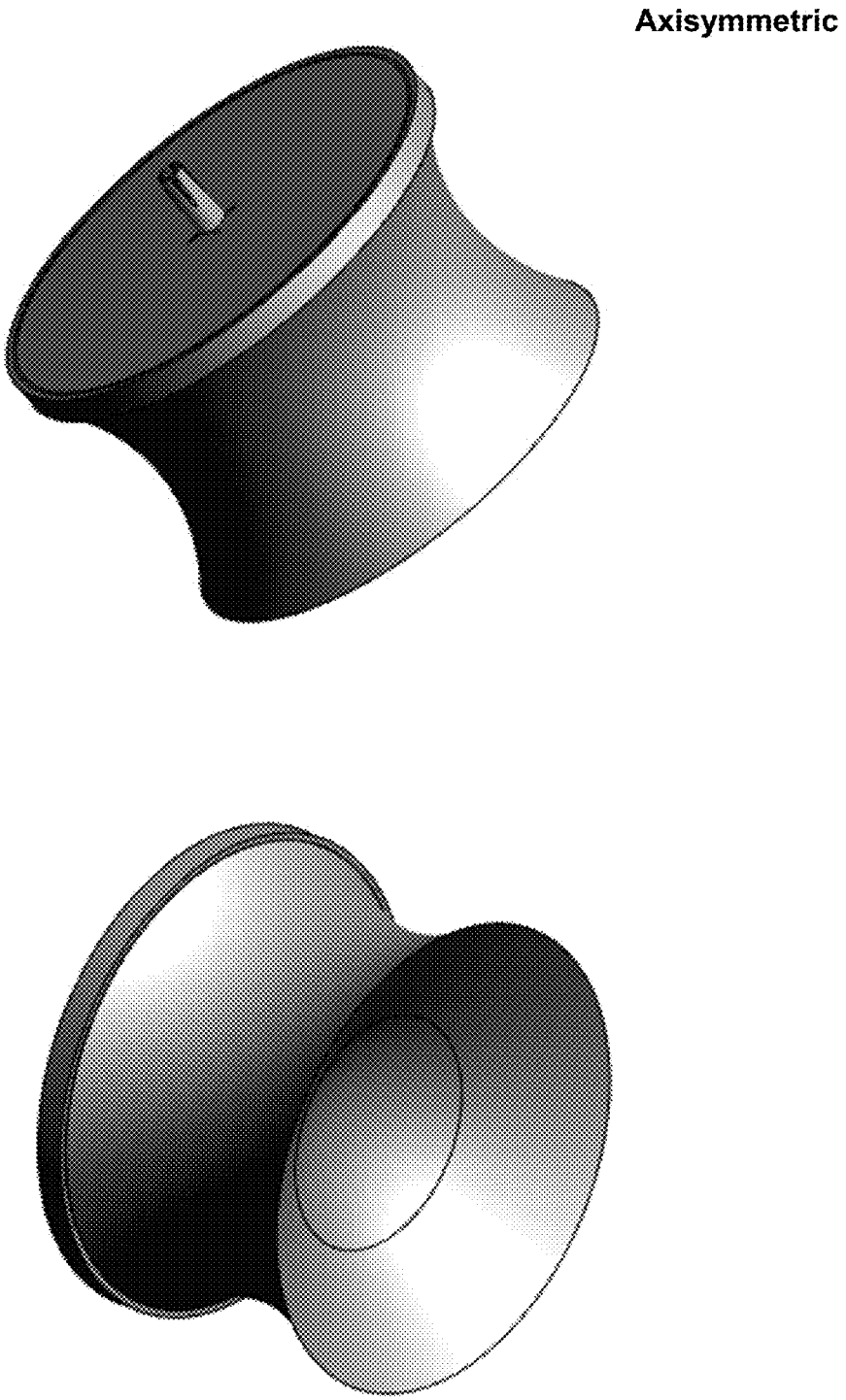
FIG. 7 illustrates an axisymmetric container, having side surfaces, along with a distal surface, that are curved. The proximal surface is illustrated as flat and having a detonator channel extending therethrough.

Referring generally to FIGS. 1-3, the shaped-charge 10 has a container 30 that defines an interior or container volume 39 to contain a liquid and one or more explosive charges. The container comprises a curved surface, wherein the curved surface is generally described as concave, with a curvature toward the container volume. In FIGS. 1-2, there are four curved walls 32 corresponding to sidewalls, that connect a top surface 36 to a bottom surface 38. Also illustrated in optional notch 31, to facilitate controlled container fracture and liquid projection out of distal surface. That optional notch 31 illustrated in FIG. 1A-1B also corresponds to a portion of a symmetry plane. Distal surface 33 faces toward a target. In the embodiment illustrated in FIG. 7, there is one curved side wall and one curved distal surface. In the embodiment illustrated in FIGS. 1-2, there are matched proximal and distal surfaces, and left and right surfaces. The top surface 36 may contain a passage 44 to facilitate filling of container volume with a liquid and/or placement and positioning of explosive charges 150. Lid 45 may be used to reliably seal the passage, and confine the liquid in the container volume. A detonator lead channel 250 provides access to reliably detonate explosive charge(s) 150 that are positioned in container volume 39 (FIG. 3A-3B), such as by a detonator or explosive firing train (detonation cord) 260. In use, upon detonation of explosive charges, the liquid is propelled toward a target in the form of a wedge-shaped liquid jet 300, with FIG. 4 (left panel) illustrating a 2-D cross-section thereof.

Notch 31 has an important function of facilitating the container surface, including a container formed of plastic, to reliably split open and thereby avoid the container surface from impacting the target. Without a notch, there is risk of a substantial plastic portion of container wall making impact with the target surface before the water. This is undesirable as there is a risk that such contact could result in uncontrolled target detonation. In an aspect, the notch may comprise a plurality of shallow grooves on the distal container surface, including the outer-facing distal surface. Any of a variety of notch lines and/or geometries may be used, so long as the plastic splits, petals, or otherwise deforms, such that the explosively-propelled water that is held within the container volume first hits and defeats the target before any container can hit the target. More preferably, no container material hits the target.

The curved walls may have a curvature that is constant with respect to axial direction 50 (FIGS. 1A-2B). That is, the curvature does not change with respect to the distance from the bottom surface 38. Alternatively, the curvature may change with respect to the distance from the bottom surface 38. For example, FIG. 2A-2B, illustrates a curved container wall that is characterized as having a biaxial profile 310, in each of the axial direction 50 and radial direction 51. The container walls may include a distal surface 33, a proximal surface 34, first sidewall 35 and second sidewall 36. Apex region 330 may connect adjacent walls, including with an apex region having a different curvature, or discontinuity in curvature at the connection edge with other surfaces.

Figure 3C:
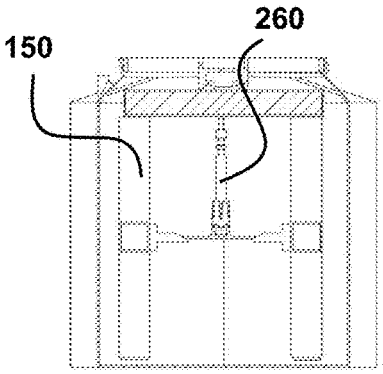
Figure 8:
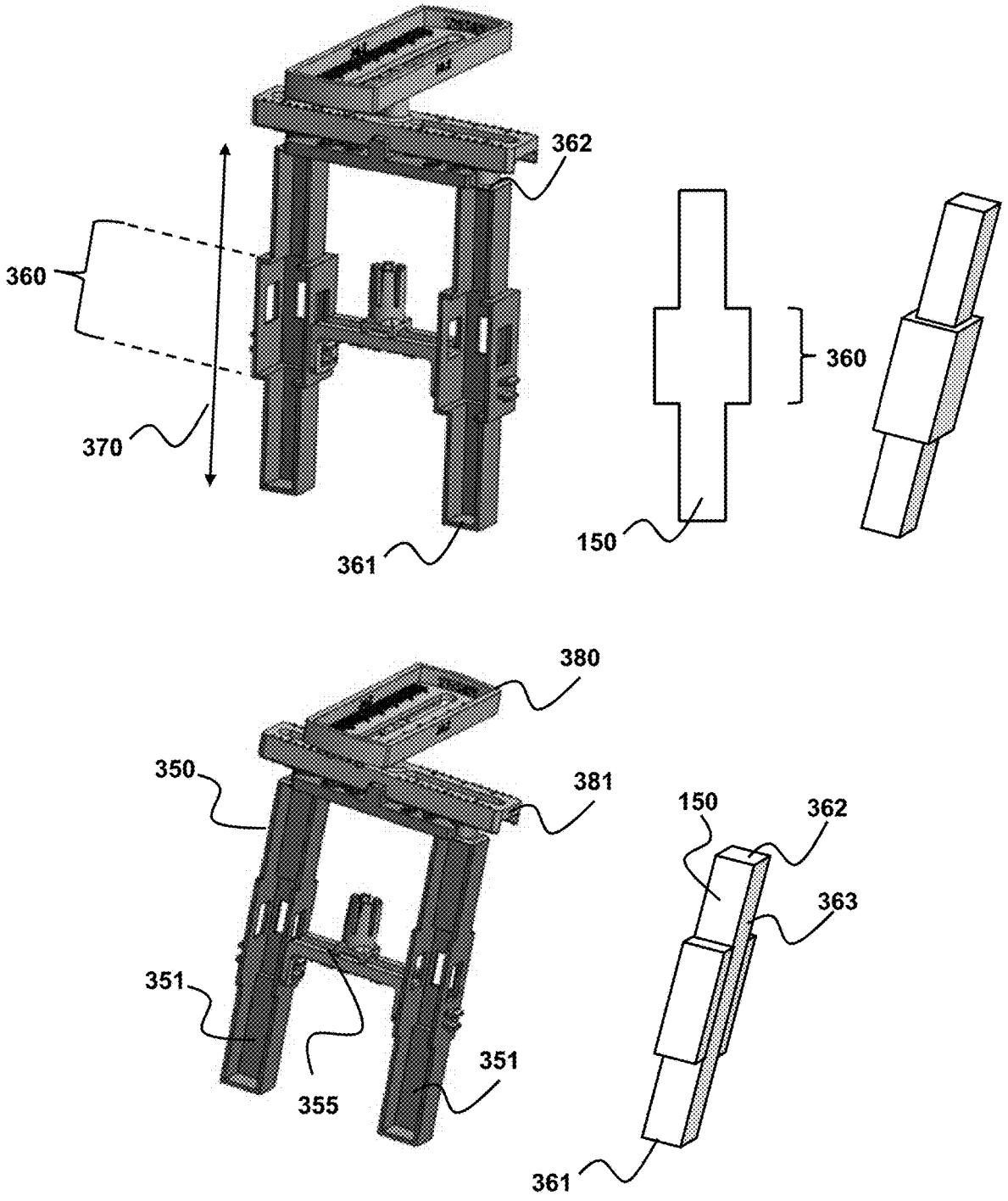
FIG. 8 illustrates an explosive holder comprising two stems and a bridge (explosive guide) to guide the explosive firing train detonative wave to contact points with the explosive shaped-charges positioned within the stems. The top panel has a higher relative mass of explosives packed into a center region and is expanded in two dimensions compared to the explosive charge illustrated in the bottom panels where the central region of the charge is expanded in one dimension.

FIG. 8 illustrates an explosive holder 350 that is configured to be positioned or placed within the container volume 39 (see, e.g., FIG. 3C). For clarity, explosive charges are not shown, but would be placed into the recess(es) 351 of the explosive holder that may correspond to explosive volume for embodiments where the explosive entirely fills the recess. In the FIG. 8 configuration, the holder is a dual-stem holder with the explosive charges accordingly characterized as being cuboidal in shape, with a central position 360 and a charge length reflected by arrow 370. Each shaped-charge may have a first end and a second end corresponding to locations 361 and 362, respectively. A longitudinal positioner 380 may position the shaped-charges at a controlled but variable separation distance from the container distal surface. A lateral positioner 381 may position the shaped-charges at a controlled but variable separation distance from the container walls.

Figure 16:
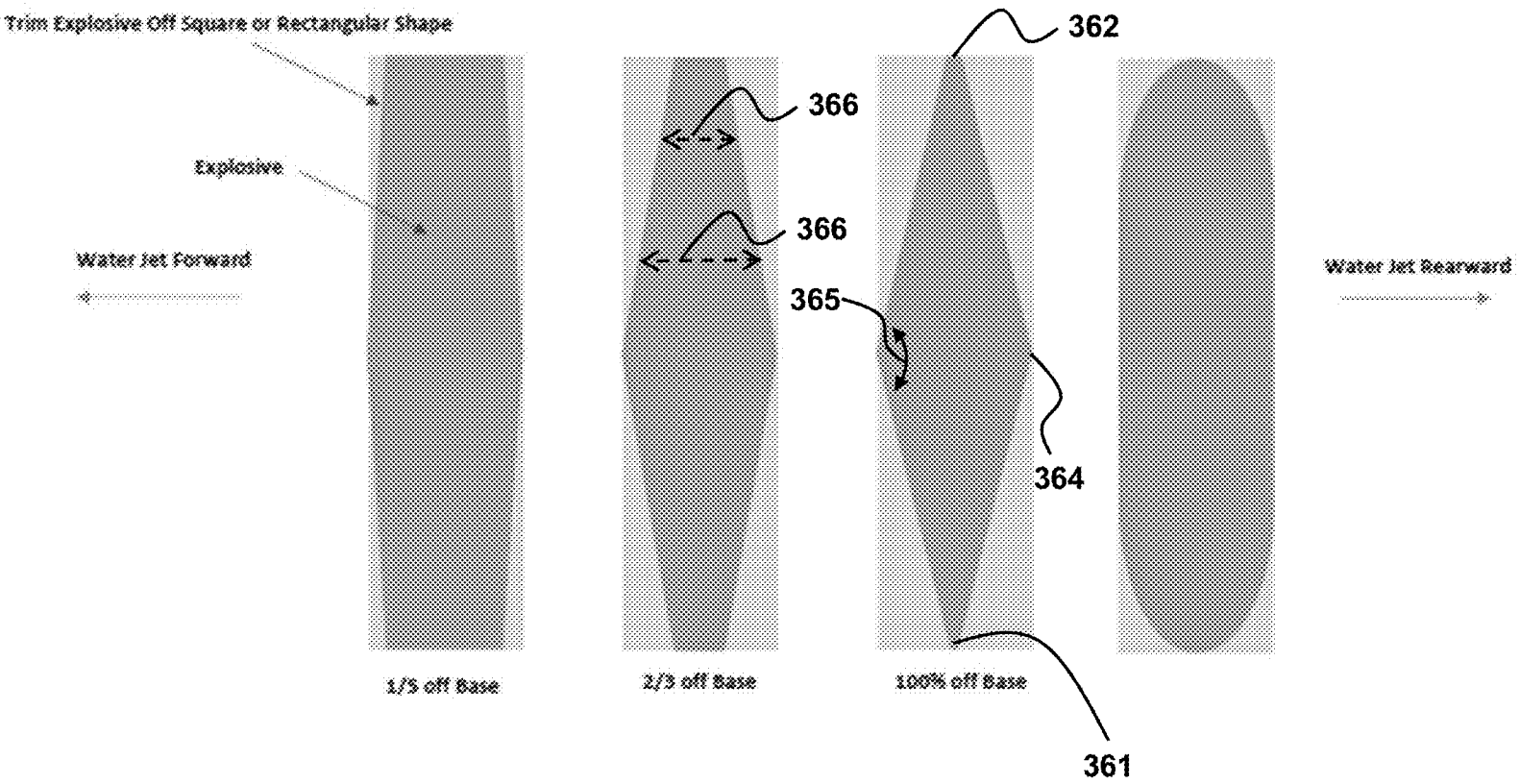
FIG. 16 summarizes various explosive charge shapes having a tapered geometry.

The right side of the FIG. 8 panels are representations of some geometrically shaped-charges, including a cuboidal shape extending from first end 361 and second end 362 with an outer surface 363 that is straight-line linear. Also illustrated is a side view of an explosive charge having central position 360 in which more explosives may be packed relative to the ends. Other exemplary shapes are illustrated in FIG. 16, including a taper geometry toward the ends such that the cross-sectional area (represented by dashed lines 366) of the explosive charge is a maximum at the center point 364 and decreases toward each of the first 361 and second 362 ends. In this manner, the explosive charge may be described as having a straight-line outer surface and/or a bent at a defined angle 365. This illustrates an advantage of the instant shaped-charge's ability to accommodate any number, position and shapes of explosive charges in the container volume. This provides another independent means of controlling one or more liquid jet parameters.

Figure 17:
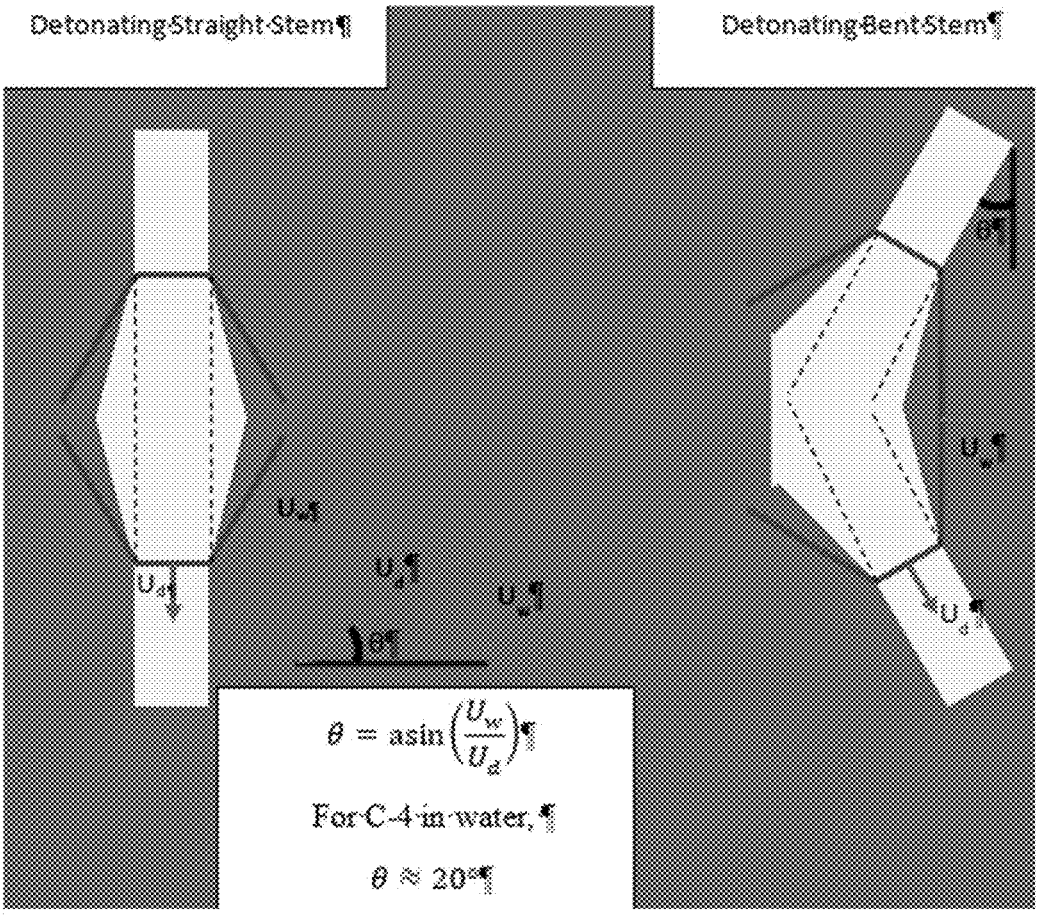
FIG. 17 illustrates a bent explosive charge configuration.

FIG. 17 illustrates geometry associated with a straight (left side) and bent (right side) detonating stem, and attendant angles and vectors.

Figure 9:
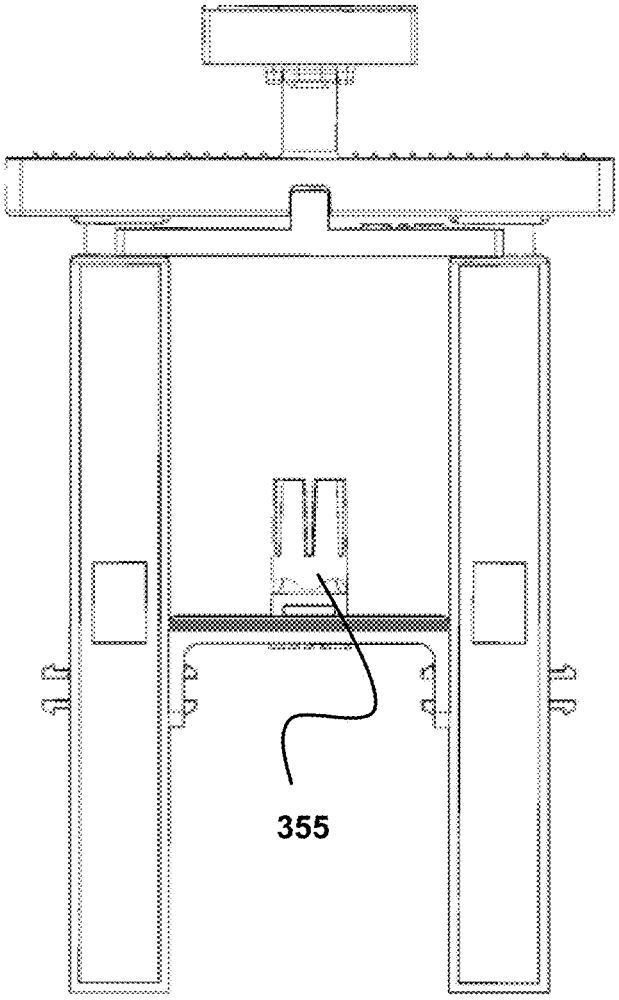
FIG. 9 illustrates an explosives holder with a single-point initiation with each of two explosive stems. This is also referred herein as an H-bridge geometry.
Figure 10:
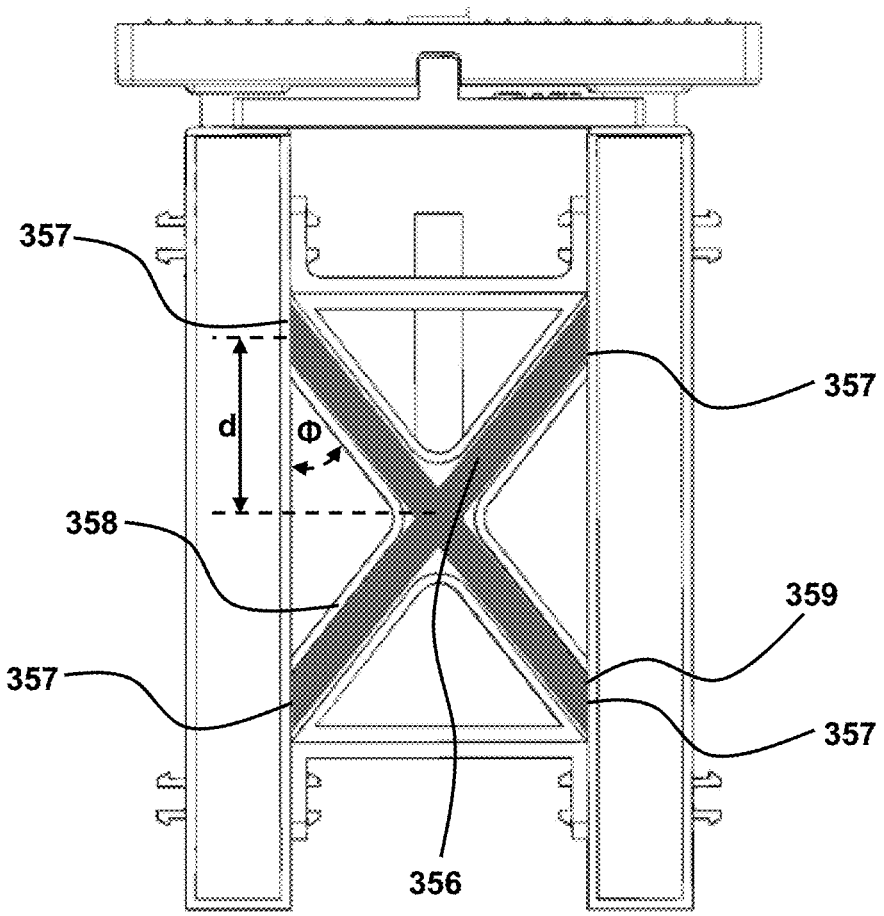
FIG. 10 illustrates an explosives holder with a two-point initiation with each of two explosive stems. This is also referred herein as an X-bridge geometry in which the explosive firing train is positioned, and can be quantified in terms of distance (d) between contact point with shaped-charge and horizontal center plane and the angle of incidence Φ with the shaped-charges. The contact point is actually a contact region, as illustrated by the relatively wide contact region between explosive firing train and each of the explosives charges.
Figure 11:
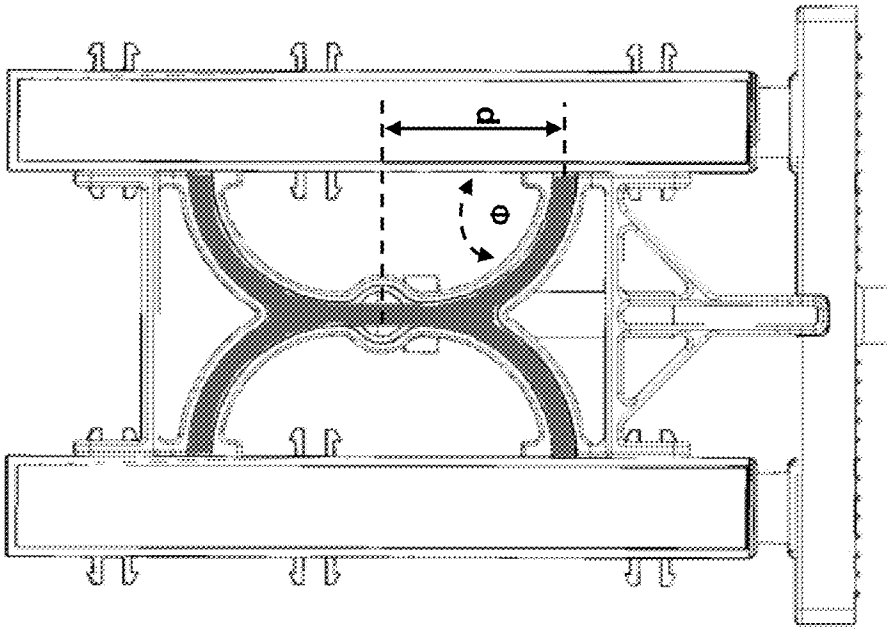
FIG. 11 illustrates an explosives holder with a two-point initiation with each of two explosive stems. This is also referred herein as a U-bridge geometry (or similarly, C-bridge; curved X-bridge, etc.). The geometry provides a bridge-stem junction that is normal, with angle of incidence Φ approaching or equal to 90° relative to the stem surface. The explosives holder provides a platform by which the geometry of the explosive firing train can be manipulated, depending on the application of interest and/or the shaped-charges.
Figure 12:
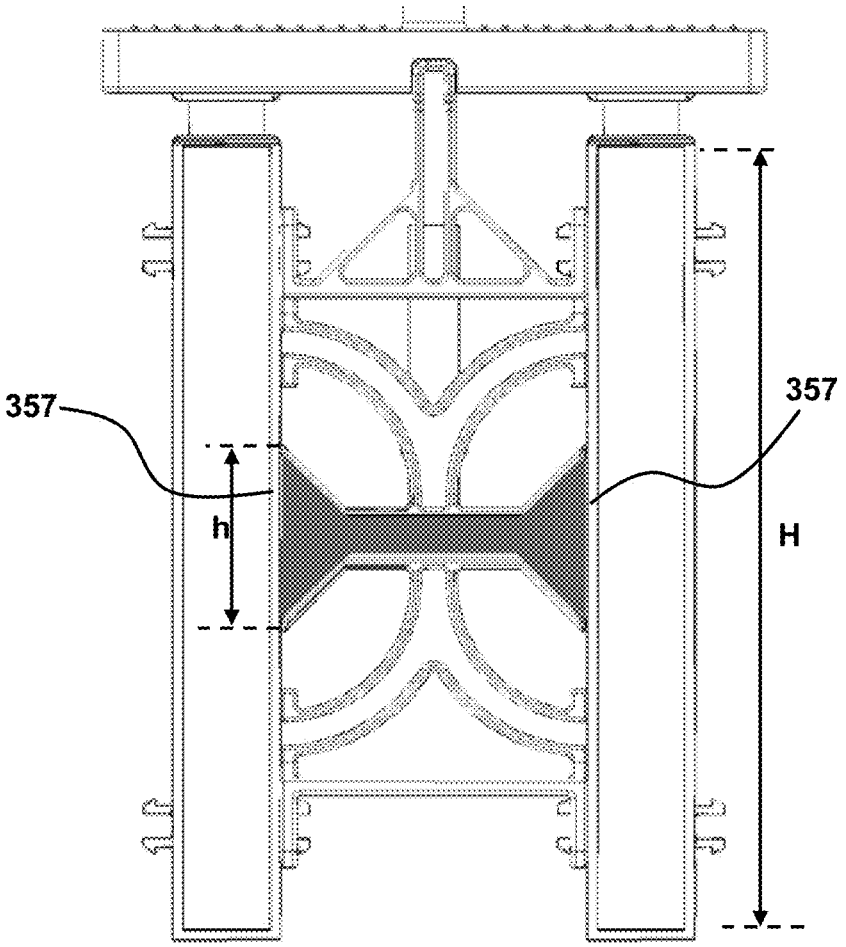
FIG. 12 illustrates an explosives holder with a single-point initiation over a large contact area with each of two explosive stems. This is also referred herein as a Bowtie-bridge geometry as the structure allows for both the U-Bridge of FIG. 11 and/or center piece.
Figure 13:
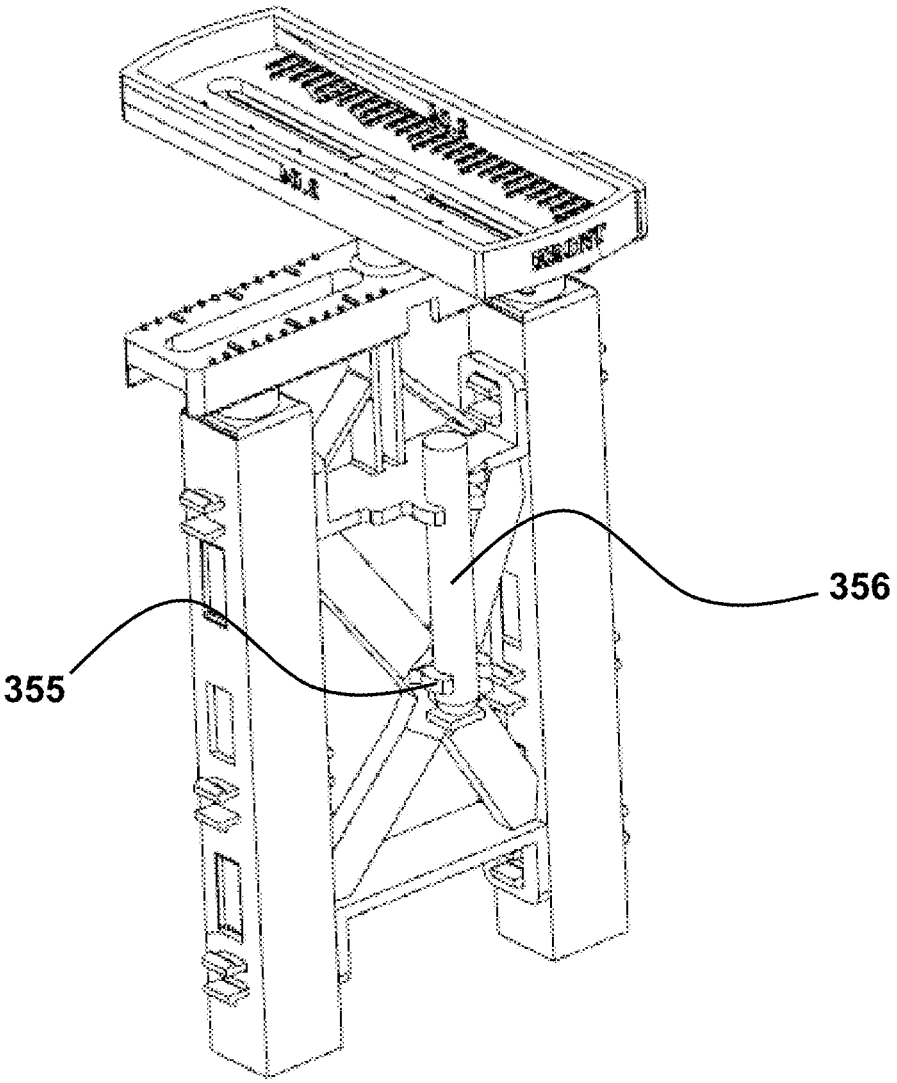
FIG. 13 illustrates another explosives holder having a different explosive guide geometry, wherein the X-bridge of FIG. 10 is angled or off-set relative to the explosive charges position. In this example, most of the bridge is positioned proximal to the explosive charges.
Figure 14:
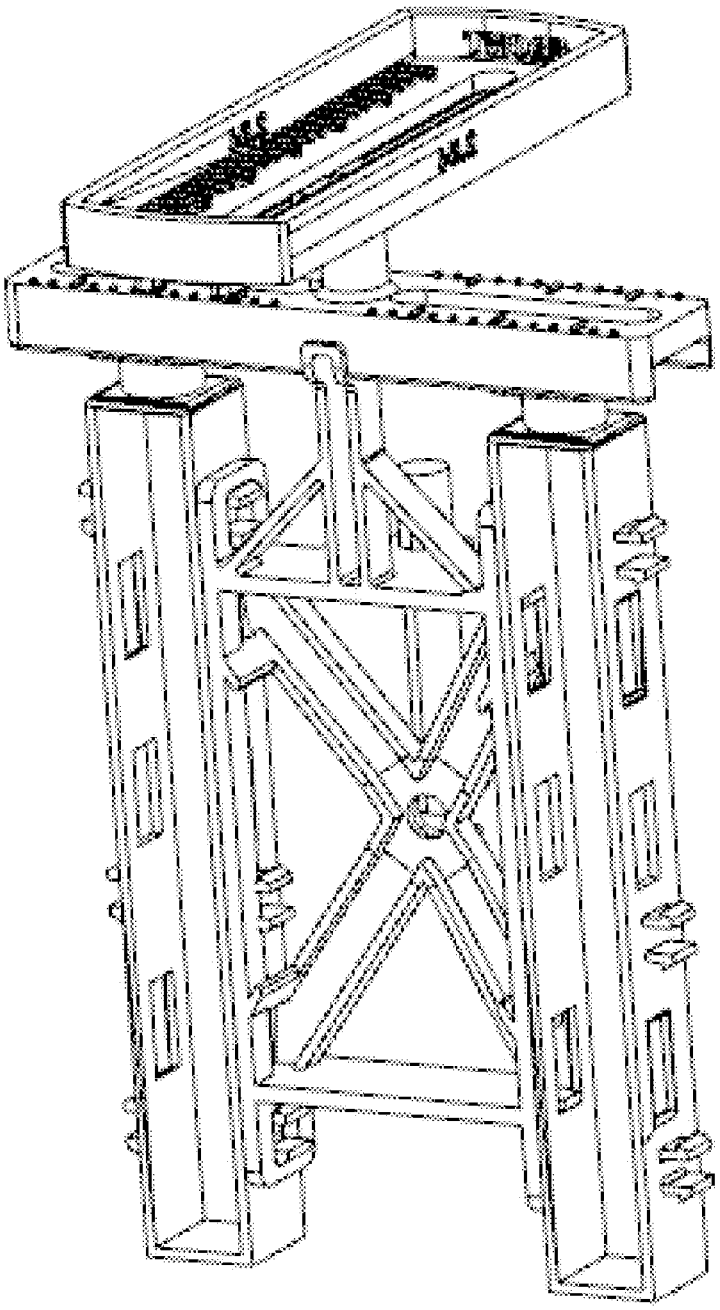
FIG. 14 is a different perspective view of FIG. 13 to help show the offset of the bridge.

Explosives holder 350 may have a channel 355 for positioning an explosive firing train 356, such as an explosive firing train positioned in explosives guide configured to have any of a number of contact points 357 with the explosive shaped-charges, including contact points corresponding to termination ends 359 of the explosive firing trains that contact the shape-charges 150. The explosive firing train is preferably composed of sheet explosives. The position of contact points 357 can be adjusted a distance 'd' from the center line by 0% to 50% of the total length of the charge or the relative angle φ can be changed from 0 to 90 degrees. Various guide geometries are illustrated in FIGS. 9-12, with FIG. 12 particularly illustrating a contact point 357 that corresponds to a contact area, with a large surface area point of contact between explosive firing train and each of the two explosive charges. The explosives holder may further comprise branches 358 to reliably position explosive firing train 356 and corresponding contact points 357 with explosive charges 150. FIGS. 9 and 12 illustrates a single contact point with each of the explosive charges. FIGS. 10-11 illustrate two contact points with each of the two explosive charges. FIG. 12 structure allows for initiating the explosives with the U-bridge or Bowtie (center piece). In the Bowtie, the Primasheet™ explosives guide allows for instantaneous initiation of the central region of the explosive stems. The central region contact length 'h' can be adjusted from 0% to 100% of the total length of the shaped-charge (H). In other words, it is a type of an infinite number of or continuous initiation points at the interface of the explosive firing train, such as Primasheet®, and the explosive stems. FIGS. 13-14 illustrate another embodiment where the explosive firing train 356 is in an offset configuration.

Figure 15:
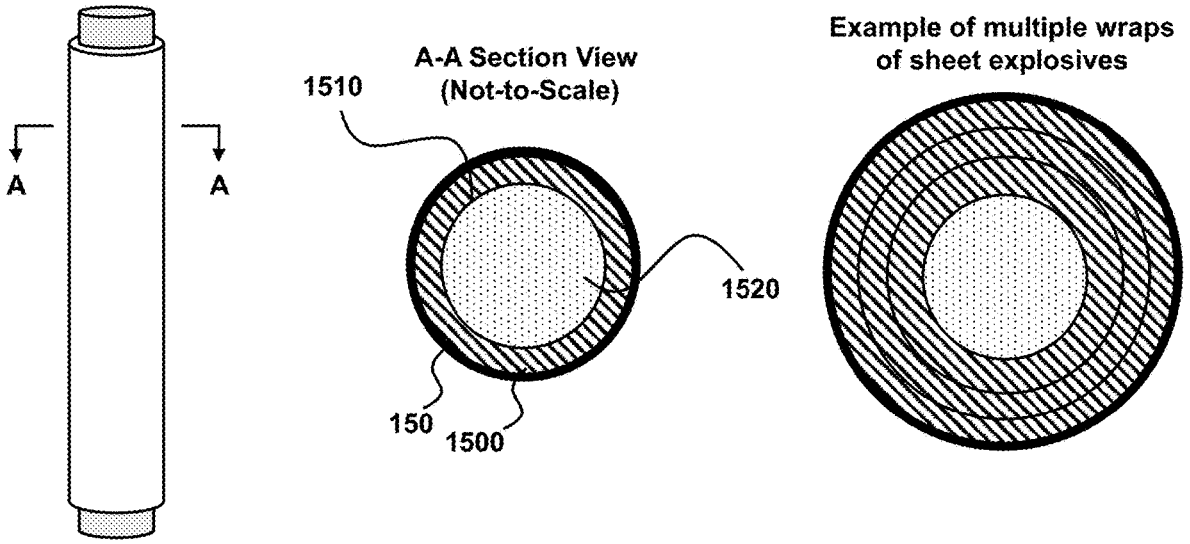
FIG. 15 illustrates another explosive charge embodiment. In this embodiment, the explosives charge is provided as a sheet of explosives wrapped around a substrate, such as the illustrated tubular cylindrical substrate with a liquid-filled orifice. Optionally, the tubular region can be filled with a solid rigid rod of material made of plastic, iron, steel, aluminum, copper, or brass, for example.

FIG. 15 is a cross-sectional view of a geometrically-shaped-charge having an explosives charge 150 that is a sheet of explosives wrapped around a substrate, including the illustrated tubular cylindrical shell 1500. The tubular cylindrical shell may have an orifice 1510 filled with a liquid 1520, including water. Alternatively, the tubular region can be filled with a rigid rod of a material including, but not limited to, plastic or steel.

Figure 18:
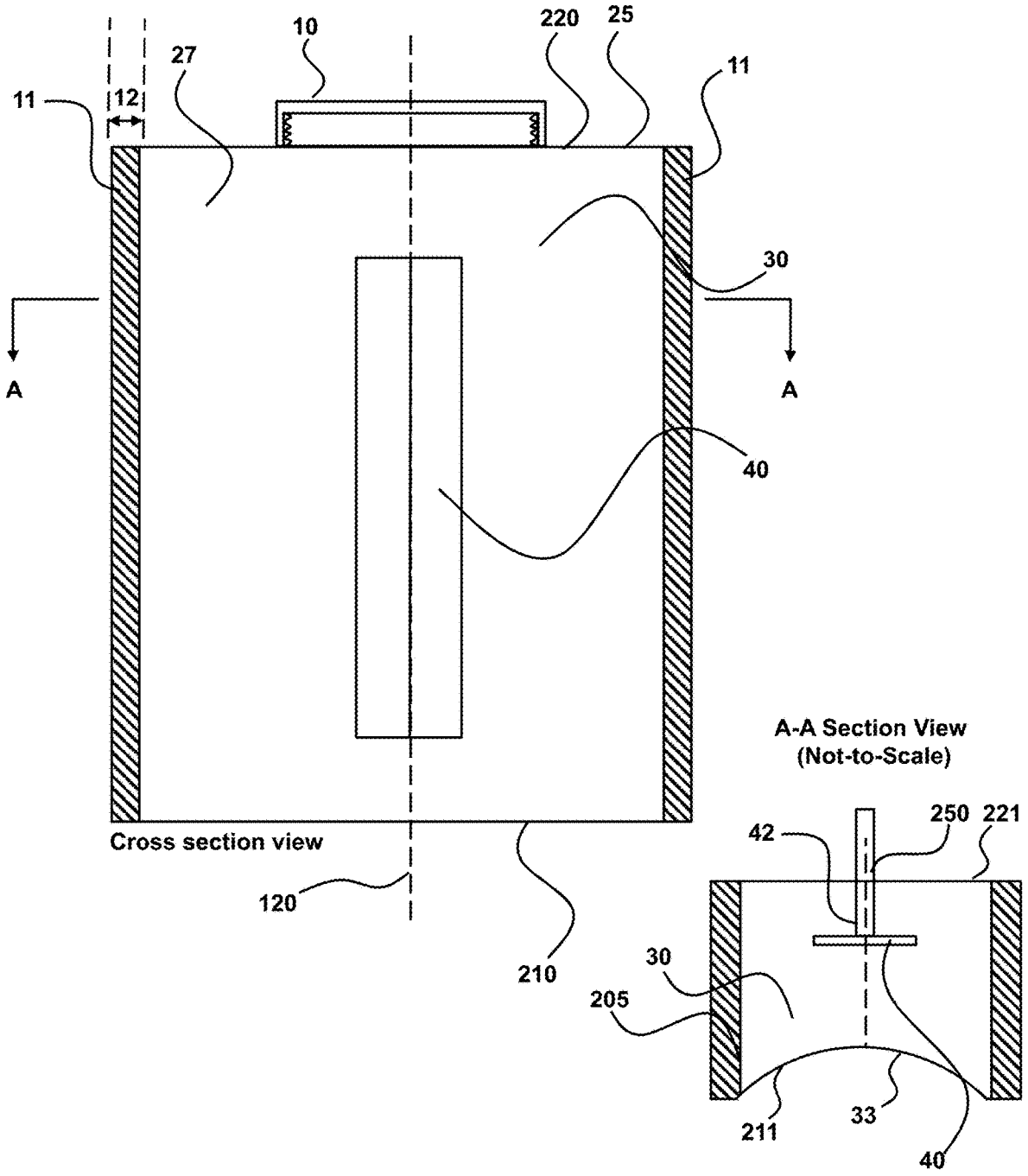
FIG. 18 is a front face sectional view of a shaped-charge having a shell surface with a geometric shape to support a shape-conforming explosive immersed in a fluid contained within a container. The shell surface provides support for shaping of explosives and focusing a filler, including a fluid mass, upon explosive detonation. An attenuating body is connected to a portion of the container surface.
Figure 19:
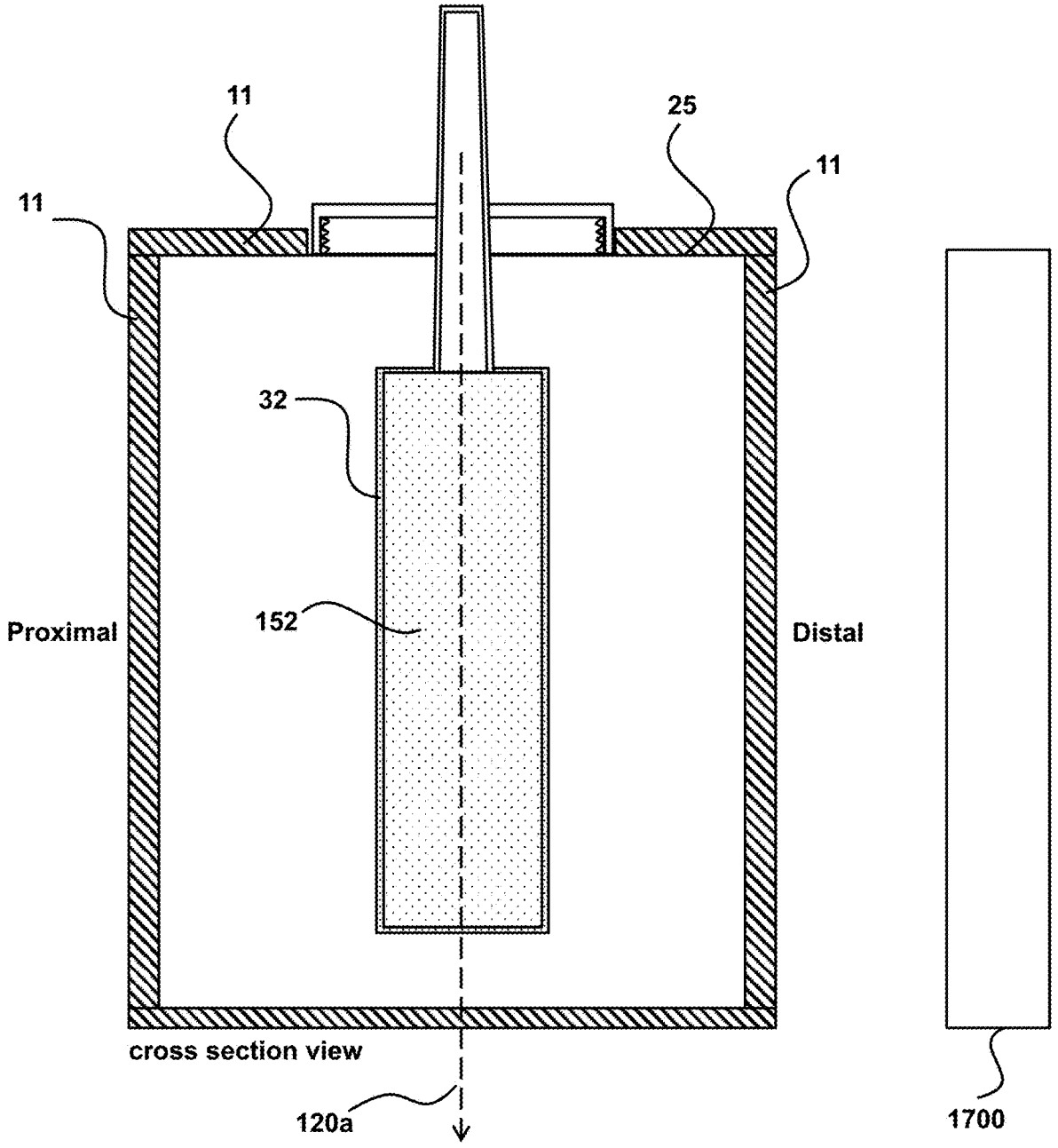
FIG. 19 illustrates where SMART forms the container walls.

Any of the shaped-charges may further comprise a SMART material (also referred herein as an "attenuating body"), including as illustrated in FIGS. 18-19. FIGS. 18-19 illustrate an attenuating body 11 connected to the container side walls. The attenuating body, depending on the application of interest, can connect to other locations of the container side walls, including most or all of the container surface, including all sides (FIG. 18).

The container 30 has a shell distal end 33, a proximal end 34 and a sidewall 35 that connects the container distal end surface with the shell proximal surface, with shell bisecting symmetry plane illustrated by 120 in FIG. 18 and central longitudinal axis 120*a* in FIG. 19 (longitudinal axis for shell container). Generally, the term "distal" refers to the surface that is nearest in the direction of the target, with proximal surface furthest from the target. Accordingly, the filler or the fluid mass is controllably expelled, including as a water jet, in a direction out of the container distal end surface, so that there is effectively an explosive volume 152 (e.g., FIG. 19). For a liquid explosive, the explosive volume 152 may be equal to or less than the interior shell volume 32 formed by shell walls 33, 34, 35, and selected depending on the application and target characteristics, with desired filler or fluid mass expulsion out of the container 25. For example, FIG. 19 illustrates shell volume 32 equal to explosive volume 152. For a shape-conforming explosive, the mass of the explosives and surface area of the explosives are relevant parameters for controlled filler or fluid mass expulsion out of the container 25 toward a target.

As discussed herein, the attenuating body 11 is selected and positioned to provide desired filler or fluid mass expulsion characteristics by controllably manipulating reflected shock waves upon detonation of the explosives positioned in the container with attendant fluid shock wave/wall surface interaction. Particularly relevant attenuating body characteristics are material composition and body thickness 12. Preferred thicknesses include a thickness between 0.03" and 1" or between 0.75 mm and 2.6 cm. The attenuating body may contact an outer and/or inner surface of container 25. In some embodiments, attenuating body 11 may contact at least a portion of a surface of the shell 30, including contacting both a container surface and a shell surface, or only one of a shell surface or a container surface. In a preferred embodiment, the contact is to an outer surface of the container 25. The container 25 surfaces may include container distal 211, proximal 221 and side surface 205. A stem 42 may accommodate channel 250 through which an explosive firing train operably connects, such as an electric detonator to initiate the explosives, with a fluid jet directed to a target 1700.

Example 2: Fluid Mass-Focusing Linear High Explosive Shaped-Charge Disrupter This example describes a fluid mass-focusing linear high explosive shaped-charge disrupter. All four sides of the liquid-filled container have a parabolic profile (see, e.g., FIGS. 1-2). Up to three high explosive charges are immersed in the fluid and are simultaneously initiated. The explosion causes pressure waves that drive the liquid, such as water or other liquid-containing material (e.g., HEET) to jet at speeds up to 5,000 fps. The containers provided herein are configured to accommodate any of a range of explosive cores that are used to controllably drive liquid from the container volume toward a target. In some embodiments, the explosives immersed in the liquid (also referred herein as "explosive cores" or "charges") are specially shaped. For example, the explosives may be cuboidal shaped composition C-4 explosive bars and quickly sectioned from machine press extruded M112 blocks. The explosives in this unmanipulated form have a density which is 35% higher than equivalent cylindrically shaped hand-packed explosive stems commonly used in other tools. Thus, the energy output of the tool is increased proportionally. FIGS. 3A-3C illustrate a side view, top view and cross-sectional cut-away view, respectively. FIG. 3B illustrates a slotted track to allow for the explosive to be controllably positioned in the container volume, including distally and proximally from the container center-line. In addition, another track, such as a perpendicular to the slotted track in FIG. 3B, facilitates controllable lateral positioning of the explosives. In this manner, the spacing between explosive stems, including as illustrated in FIG. 3C, can be adjusted, thereby adjusting one or more jet properties to tailor the jet properties based on the target conditions.

Figure 5:
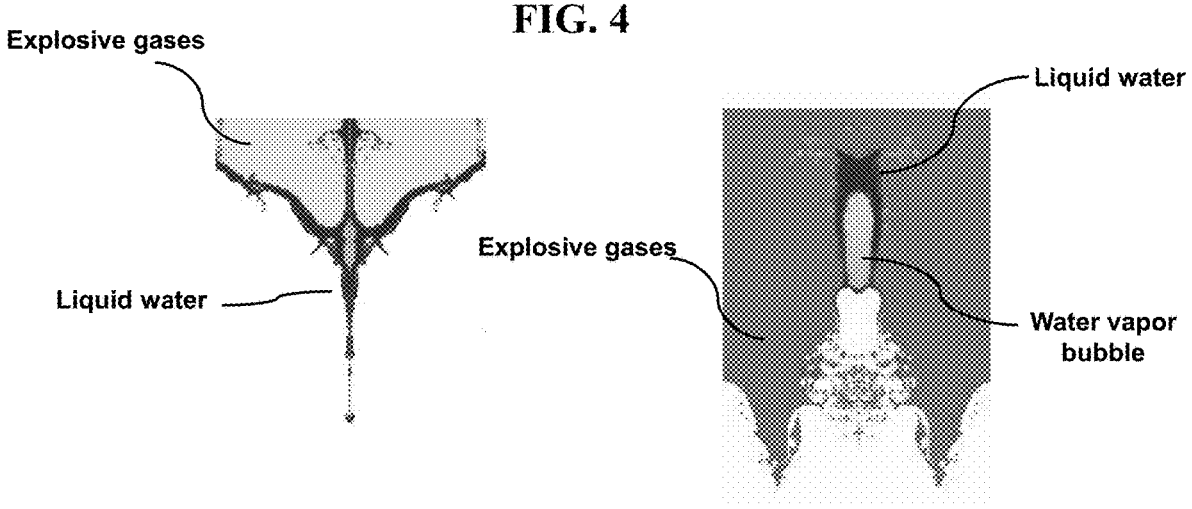
FIG. 5 are hydrocode results comparing the instant curved container walls (left panel) and flat container walls with a chevron-shaped explosive former (right panel). Explosive gases expand out front of the jet non-curved walls (right panel) which are avoided in the instant curved-shape wall containers (left panel).

The disrupter may be generally referred to as the fast-loading explosives, catenary profiled fluid-focusing linear shaped-charge (FLExCAT). The FLExCAT produces a wedge-shaped fluid (e.g., liquid or liquid having particles suspended or confined therein) jet that will access and disable hazardous devices such as improvised explosive devices (IEDs) and explosive ordnance. In addition, the tool can be used to breach barriers such as walls, windows, and doors. The FLExCAT is engineered to produce a long jet that is approximately two to five times the length of other similar-sized linear mass-focusing high explosive shaped-charges. The most common fluid used in bomb disrupters is water, but others can be used, such as HEET (U.S. Pat. No. 11,187,487). For convenience, water jets will be the focus of our discussion in this example, but the invention is compatible with any number of liquids or fluids, including any of those described in U.S. Pat. No. 11,187,487 which is specifically incorporated by reference herein for the HEET fluids described therein. The FLExCAT water jet stretches but the jet tip does not break apart due to a steady flow of the water into the jet. Most liquid jet's fluid density drops rapidly with jet elongation because of hydrodynamic and shock stresses causing atomization, gasification, and aeration (compare, e.g., FIG. 5 left panel with right panel). The left panel shows FLExCAT density remains high, and for water, has been shown with CTH hydrocode simulations to maintain a liquid density of 1 g/cm$^3$. The right panel is a mass-focusing charge with similar explosive weight and water mass, however, it has flat container surfaces on its sides, front and back. A considerable amount of the water volume is vaporized and the explosives gases escape around the water slug; the explosive gases are rapidly expanding in front of the water jet. Of note, the preferred charge geometries described herein for the FLExCAT, which also contribute to its efficiency, are not in the conventional disrupter modeled by CTH in the right panel.

An approximate 35% increase in energy output is due to using the composition C-4 plastic explosives at the density of an M112 demolition block. The demolition charge is formed under pressure resulting in de-airing of the composition C-4 explosives. Typically, the explosives are extruded under pressure to make the rectangular shape at a maximum density of approximately 1.6-1.65 g/cm$^3$. Most uses of composition C-4 in mass focusing high explosive charges requires it to be shaped like modeling clay into a cylindrical former. The handling and shaping of the explosives cause it to lose its density as air is trapped inside of it. Operators will use small pieces of the composition C-4 block and press them into the charge former using a plastic rod to increase the density; the measured density of the repacked explosives is, however, only 65% of the original density of the M112 demolition block. The energy output of an explosive is proportional to its density and so using the cuboidal shape allows sections of the M112 block to be cut to size. No manipulation of the explosives is required, which also decreases preparation time. In this manner, in an embodiment the FLExCAT is described as using a high-density explosive charge to explosively drive a liquid jet toward a target.

Another way to minimize charge loading time and to maximize explosive density is to layer sheet explosives into a cuboidal or a cylindrical shape. C1 to C6 thickness RDX or PETN-based sheet explosives can be cut into rectangular strips and stacked to the desired thickness. The alphanumeric code for explosive volume of sheet explosives is as follows: C1 is 1 g/in$^2$, C2 is 2 g/in$^2$, C3 is 3 g/in$^2$ and etc., Composition C-4 contains 91% by weight RDX. RDX-based sheet explosive is comparable because it contains 87% by weight RDX and has a similar density to an M112 demolition block. Although PETN has a slightly higher Gurney Energy than RDX, the PETN-based Primasheet will have a lower energy output because it contains 63% by weight PETN and so has a notably lower net explosive weight. Additional wraps of PETN sheet explosives are needed to equal the net explosive weight of the RDX-based explosives. As an alternative to stacking sheet explosives, a hollow plastic cylinder of a specified radius can be wrapped with layers of sheet explosives. The inside of the cylinder will fill with water and enhance the explosive effects. A solid rod can also be used in place of the cylinder and in this case plastic or metal rods can be used; the latter will produce higher pressures and thus increase efficiency of the explosive system. Another explosives option is detonation cord which is filled with flaked PETN and it can be cut to length and slid into a cylindrical tube. However, detonation cord is of much lower density compared to the explosives referenced above and will perform less work.

Water-filled shaped-charges lose a good portion of their water slug because of a phase transition to gas through a cavitation process. Cavitation causes a water vapor bubble to form at the disrupter center and at its corners. The bubbles progressively grow. After initiation of the explosives, the shock waves travel to the container-air boundary, and due to shock impedance mismatches between the water-filled container and the air, the waves reflect and form a release wave, also referred to as a rarefaction wave. The negative pressure wave causes the water to vaporize. Continued shock reflections at the gas-liquid water interface and the liquid water-air boundary, results in the bubbles' expansion. The central bubble typically forms within the jet and can destroy it.

The FLExCAT is configured to minimize cavitation based, at least in part, on three aspects. The first is by shaping all four sides and corners such that the sectioned profile of each surface is a parabola; including a catenary profile. This causes the reflected release waves to radiate rather than focus or reflect as a planar wave. There is an exponential drop in pressure wave amplitude with respect to distance from the water-air boundary at the surface of the container. At the disrupter's front (distal) face where the liquid jets toward the target, the primary reflected wave is attenuated due to the parabolic shape of the distal face. The FLExCAT also reduces the colliding shock reflections at the corners of the water-filled container. Using different curvatures for the parabolic shapes at the front and the sides removes symmetry and results in reduced amplitude of the interacting release waves at the corners. The collision plane shifts toward the side and not the center of the charge. Replacing the front-side junction with an apex also reduces the rarefaction wave collisions.

The second aspect that reduces cavitation is to use circular rod or square pillar-shaped explosives. When using two or more stems, explosives are separated by a specified distance laterally and frontally. The shocks produced by the charges are attenuated before they collide along the symmetry plane between the charges. Increasing the spacing reduces the mach stem effect and amplification of the pressure. The water in the central plane experiences the highest shock pressures and thus the reflected release wave is higher in this region and is proportional to the incident wave. CTH hydrocode simulations has shown that other charge geometries using shell surfaces to shape sheet explosives cause intense reflected shocks and significant cavitation.

The third aspect that controls water gasification is to use Surface Material Attenuation of Rarefactions Technology (SMART), including as described in U.S. Pat. App. No. 63/295,347 filed Dec. 30, 2021 (Vabnick et al.) (corresponding to U.S. Pat. Pub. No. 2024/0068767), which is specifically incorporated by reference herein for the attenuating layers and use in shaped-charges as described therein. SMART uses various layered materials that cover the front and/or sides of the container and dampen the effects of the destructive rarefaction waves. Placing materials on the side of the container also changes the timing of the reflected wave from the side colliding with the wave reflected from the front face. The result is a reduced mach stem effect and less water vaporization at the disrupter corners. The materials attenuate the primary shock before it reaches the air boundary and the reflected shock is further attenuated as well through the material before it arrives at the water boundary. There is an increase of up to 50% in jet penetration, impulse, and cavitation using SMART.

The forward velocity gradient (FVG) is essential for jet formation and growth in length. The FVG, however, is also a destructive hydrodynamic characteristic in all fluid focusing shaped-charges. Under a FVG, the jet continues to stretch until the tension causes the jet to break apart. Most liquids cannot withstand tension and atomize quickly. The jet turns into droplets, thus losing the jet's bulk density and its ability to transfer momentum and energy to a to-be-disrupted target. The FVG can be explained qualitatively by dividing the jet into discrete elements. Proceeding from the rear (proximal) of the jet to its front (distal), each element is progressively faster. The rate of jet stretch increases with explosive load. The FVG must be regulated to allow the jet to perform work over an effective range. Spacing laterally and positioning relative to the container face of the explosive charges and the number of charges can affect jet stretch. The FVG can be complex and may not be linear, but in the case of the FLExCAT, CTH modeling indicates the FVG is linear. The FLExCAT disrupter FVG is considerably reduced compared to other disrupter high explosive shaped-charges described herein. The curved container walls of FLExCAT, including a parabolic shape, also collimates the fluid as was shown for the Catenary Advanced Technology (CAT) (U.S. Pat. No. 10,921,089). In the FLExCAT, it takes longer for the jet to stretch apart and atomize. The degree of curvature on the container's parabolic profile has an effect on jet stretch rate. Lessening the curvature slows the rate of jet stretch. Furthermore, incorporating SMART with FLEXCAT (curved container wall surfaces) can also control jet stretch by placing material on the front face of the charge. The jet stretch is slowed because the forward velocity gradient is reduced.

Using SMART, non-ideal materials (foams) with a minimum material thickness and specified profile are seated at the front (distal) disrupter face and reduces the velocity gradient within the water. The pressure differential at the water material boundary is lower than if the boundary was with air. Hydrodynamics dictate a lower velocity of the water. The water particle velocity at the foam interface is lower than without the foam and thus the velocity within the water jet is normalized. The common characteristics of the preferred materials for placement on the disrupter face are low density, low speed of sound, and non-ideal materials. This helps reduce both the FVG and the amplitude of the rarefaction waves. Foams formed from polyurethane, silicone, polyvinylchloride (PVC), nitrile, neoprene, sorbothane, high density polyethylene, and teflon produce good jetting behavior. The preferred density range is 0.15 g/cm$^3$ to 0.5 g/cm$^3$. The preferred profile follows the contour of the container face. However, the cavity can be completely filled in to effectively create a flat foam front at the most distal portion of the SMART foam material. This form has the greatest effect on the velocity gradient. A reduced jet stretch rate means that the jet takes longer to form and it takes more time to break apart due to tension. The outcome is the water jet is continuous at greater standoffs; this provides one aspect for being able to disrupt targets at greater stand-off distances. The FLExCAT container can be cut from foam making the SMART integral to the disrupter. For example, the container wall itself can be the SMART material.

It is worthwhile to describe conventional high explosive shaped-charges that produce fluid jets. There are several commercial and improvised shaped-charges that drive water, and each have their strengths and weaknesses. The simplest designs are for omnidirectional disrupters that use a rod or axially aligned central core of explosives that is hand-packed or pre-formed by an extrusion process. They drive water in a radially expanding fashion and the jet breaks up quickly due to hoop stress. In contrast, water jets can be focused using the common method of attaching sheet explosives to a plastic shelled former which is either seated inside the fluid, sandwiched between fluid chambers, or is placed on the outside surface of the fluid container. Pressure fields are produced by shaping sheet explosives into hemispherical, parabolic, linear (wedge or hemi-cylindrical), rod and conical charge geometries. When the explosives are initiated, shocks form inside the water volume and reflect from the free field surfaces. Various parameters such as angles and corners within the container of fluid or on the explosive former define the pressure-time history of the gases and shocks acting on the water. There are regions of high and low pressure that will differentially accelerate the water to form a jet. High pressure regions are due to a Mach-stem effect which are formed by collisions of shocks, usually along a central axis or plane. A slug of water is the projectile, and water behind the explosives traps the gases, thus increasing the duration of pressure acting on the slug. Shocks can also reflect off the tamper behind the explosives and move back into the water, amplifying the pressure. The result is a focusing of the water mass and the jet travels a distance before breaking apart due to the stresses described above.

Omni-directional fluid driving high explosive disrupters are good at delivering high impulse to a target and drive water in all directions from the central axis. Generally, these tools have axial or translational symmetry. Omnidirectional tools produce low density jets that particulate into droplets. A commercially available disrupter that uses a similar approach to the FLExCAT to maximize explosive density is the Blockshot™ (US2014/0224101 A1). There is no hand-packing of the explosives and therefore maximizes the explosive density. The Blockshot™ has a single explosive core. The disrupter has a rectangular container with flat faces and an internal housing that holds approximately a ⅛ sectioned cuboidal piece of an M112 demolition block. Due to the large flat surface of the explosives relative to the container size, a planar shock is produced and thus provides some directionality to the water jet, but for the most part the water jet is omnidirectional. Other omnidirectional tools are the Cherry Engineering Inc.'s Mineral Water Bottle (MWB) charge, and the Alford Technologies' Bottler charge (U.S. Pat. No. 9,322,624). They use a hand-packed rod-shaped explosive charge at the center of a cylindrically shaped container. The MWB produces a radially expanding wall of water that exponentially thins with distance from the charge center and forms water droplets. The notable difference in the Bottler are three hemi-cylindrical indentations on the outer bottle surface. The majority of the MWB and Bottler container surfaces are convex in appearance from the perspective of one looking from the outside-inwardly. This convex geometry results in release wave amplification and rapid loss of liquid water due to gasification.

Figure 4:
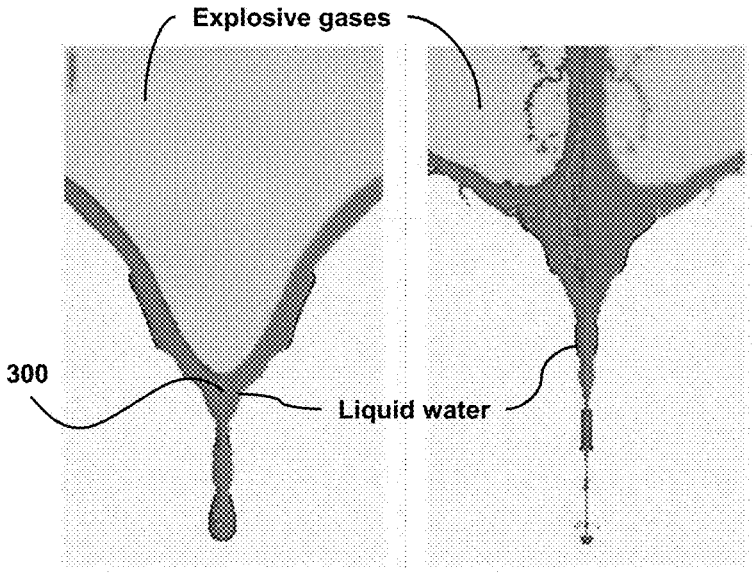
FIG. 4 is a hydrocode simulation of an instant shaped-charge with a single (left panel) and two (right panel) stem explosive cuboidal-shaped or "stem" explosive charges.

Concavities or dimpling on the face of water charges have been shown to cause jetting. The container surface indentation creates a shock cavity effect and the fluid jets at the center of each concavity. Although this is not a primary function of the parabolic shape for the FLExCAT, it does contribute to jet formation. Concavities at container surfaces can cause linear jets if the containers have translational symmetry. The jetting is due to a reduced distance between the container surface and the explosive charge at the center of the concavity thus this liquid has higher pressures overall at the cavity apex. In addition, the pressure along the air-water boundary causes the liquid to move inward because the air is compressible, low density, and readily displaced. As a result, the FLExCAT container can be used with a single explosive stem to produce linear jets (FIG. 4). FIG. 4 illustrates 2-D CTH hydrocode simulations of the FLExCAT with a single (left) and double (right) stem. The jet tips are at a distance of two times the charge width. Note the wedge shape of the jets. No explosive gases expand in front of the jet, but rather are trapped behind the water. The jets are at the density of liquid water.

Using plastic shaped sheets to create a surface to shape sheet explosives is a conventional method to mass focus water or HEET, including as described in U.S. Pat. No. 11,187,487. In the case of the Hydrajet™ (U.S. Pat. No. 6,269,725), a tall pyramidal chevron-shaped wedge of sheet explosives with an apex angle of 90 degrees is placed inside a cylindrical shaped fluid-filled container. Cherry proposes an adjustable apex angle and a scalability in disrupter size. Another example of a linear charge is the mod series of disrupters (U.S. Pat. No. 6,584,908 B1). In that case, rather than a wedge, it is an arc section of a hemi-cylindrical shape. Alford et al. use two separate water chambers and sandwich sheet explosives between them. The jet profile is similar to the Hydrajet™. Those linear high explosive charges form blade shaped water jets. Based on flash x-ray and CTH modeling, a cross sectioning of the jet would have the profile that is approximately a narrow ellipse. Those tools show a good balance of impulse and penetration of small to medium-sized thin skinned IEDs.

Some water-based charges are more effective at perforating barriers such as liquid follow-through (LIFT) charges (U.S. Pat. No. 4,955,939). Conical LIFT charges may appear similar in shape to the CAT disrupter (U.S. Pat. No. 10,921,089), but have an air void in the location where the water slug would be present in the CAT disrupter. The CAT charge has a plastic shell to shape and layer sheet explosives. The shell has a parabolic base and truncated cone section nearest the rim. Conical disrupters and the CAT disrupter are axisymmetric and they form liquid jets that are circular in cross section. The explosives in the LIFT systems are cuboidal or cylindrical blocks placed at the rear of the disrupter and oriented so that a flat face is abutting the water. The detonator is positioned coaxially down the center of the charge. The explosive detonation wave shock couples at the water interface producing an approximate planar shock front that travels into the water surrounding the hollow cavity causing the water to collapse into the void and jet forward. The thin plastic liner collapses on itself and flows at the leading edge of the jetting fluid. Another example of a conical LIFT charge is the Rocksmith Precision Closer™ (U.S. Pat. No. 8,677,902). The cone angles are approximately 45 to 60 degrees and the jets are moving at extremely high velocities, traveling in some cases in excess of Mach 10. A larger example of a conical LIFT is the Scalable Improvised Device Defeat (SIDD) disrupter which can hold five gallons or more of water.

An example of a linear LIFT charge is the Stingray™ (U.S. Pat. No. 8,091,479) and a similar collapsible charge (U.S. Pat. No. 9,429,408 B1). The cuboidal explosive charge is placed at the back of the disrupter and has no fluid tamping. The water surrounds a 'U' shaped profiled cavity. The container lines the inside of the cavity and collapses to form a plastic slug that jets forward with some water following behind it. LIFT charges generally produce narrow fluid jets of low mass. They have high jet stretch rates and are good barrier penetrators but yield low bulk work on media and low impulse in experiments. As a result, they are relatively poor general disruption tools.

Figure 6C:
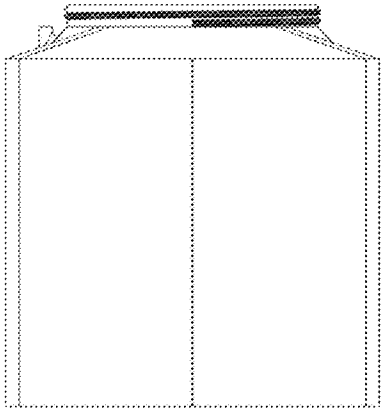
FIGS. 6A-6C are front views of the containers, with a standard size (FIG. 6A), a translationally-scaled container (FIG. 6B) and geometrically-scaled container (FIG. 6C). The different size containers are useful for different target scenarios, including target size, composition and stand-off distance.
Figure 6B:
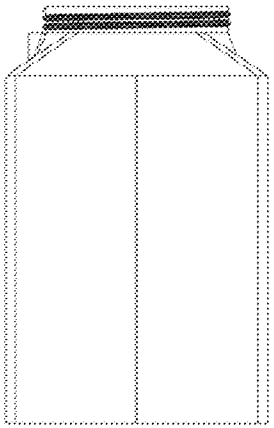
Figure 6A:
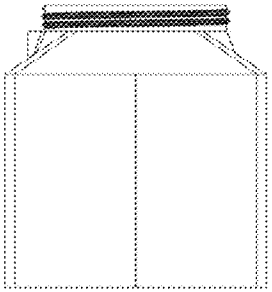

Linear shaped-charges typically have translational symmetry and will result in a perforation that is proportional to their length. Due to this translational symmetry, shaped-charges can be scaled along the symmetry line while keeping the other dimensions constant. This results in the same quantity of explosives per unit length and a jet that has no height limitations. Thus, a jet can cover the height of the entire bomb or target. Linear scaling of the disrupter length produces a small increase in jet velocity and an increase in target penetration, thus the disruption metrics for a linearly scaled charge to its original size is approximately the same. A disrupter can be translationally scaled up (compare, e.g., FIGS. 6A and 6B), for example, to cut a house door in two or scaled down to cover the height of a shoebox-sized bomb. The advantage is minimizing the weight of the fluid-filled charge because the weight growth is linear. A key advantage of a linear disrupter jet covering the entire height of a bomb is that the jet will have a higher probability of hitting fuzing components and destroy them because their position may be unknown. In contrast, axisymmetric charges cannot be translationally scaled to improve the perforation height, but instead radially scaled to increase the cross-sectional area of the jet resulting in a radius squared dependent increase on fluid mass. The axisymmetric charges produce long jets that greatly enhance penetration depth compared to linear charges. Thus, linear charges have to be placed closer to the target.

A linear charge also can be geometrically scaled to improve penetration (compare, e.g., FIGS. 6A and 6C), but now the disrupter volume grows cubically. This limits the portability of the disrupter. The FLExCAT has been shown in CTH hydrocode modeling to have long jets compared to other linear charges and thus will have good depth of penetration through IEDs and standoff distances that are greater than two to three charge diameters. Geometric scaling also requires the explosives to be scaled in order to have penetration increase by the scaling factor and keep the velocity of the jet the same. Geometrically scaling a disrupter without geometrically scaling the explosives results in a loss of jet velocity, which may be beneficial to reduce impact pressures on a bomb's main explosive charge. Water jet impacts on explosives can cause them to detonate. The larger liquid mass will still retain the jet length and impart a higher impulse and cavitation than that produced by the smaller disrupter. Accordingly, any of the shaped-charges provided herein may be linearly (translationally) or geometrically scaled to ensure, depending on the target dimensions, target coverage by the jet is achieved.

Controlling the velocity of the jet balances performance with the negative result of shock initiation of the IED explosives due to impact pressures. Provided herein are shaped-charges and related methods for controlling the jet tip velocity and the jet velocity profile with respect to jet length. Obviously, the quantity of explosives can be changed to increase the charge to mass ratio and drive the water at higher velocities. The greater mass of explosives results in the increased duration of the gases acting on the liquid and thus results in higher velocities. The position of the charges relative to the front (distal surface) of the container also has a great effect on velocity. The closer the charges are to the distal surface in the FLExCAT, the higher the velocity. The spacing between the two explosive stems can affect velocity. The closer the spacing, the higher the velocity. The curvature of the container profile also effects velocity. A higher curvature of the charge face produces a higher velocity. For sheet profiles of shaped explosives, the increased concavity of the shell or narrower apex angle of a wedge all are ways to drive liquids at higher velocity due to increase in the constructively formed shock wave due to the shock collisions. The FLExCAT configuration provides access to any of a number configurations to tailor the jet, including one or more jet parameters, such as velocity, size, shape and volume. Curvatures may be adjusted, explosive position and/or number of stems can be adjusted.

We have examined the effects of the explosive shape on the jet's formation and the jet's density with respect distance from the charge face. Using the FLExCAT container, forming explosives into classic chevrons and hemicylindrical shapes does not improve the jet density or length with respect to distance. Furthermore, using two parabolically shaped shells of explosives facing each other at various angles did not improve jet density. Reversing the curvature relative to the charge face from concave to convex did not improve the jet. The deleterious cavitation effect using the above referenced sheet geometries was notable in computational simulations. The best results were observed using cylindrical rods and cuboidal bars. If three stems are used, they can be spaced laterally in a line or in a triangular pattern such that one rod is distal. As noted above, one explosive stem can be used and, in this configuration, the charge is centered in the fluid.

In a preferred embodiment, two explosive pillars are positioned in the container volume with a specified gap between the pillars along a lateral line (see, e.g., FIG. 3C). The spacing is adjusted to maximize jet density and velocity. The ratio of the distances between the lateral line and the container front and rear is also adjusted to maximize jet fluid density and velocity. Historically, a small mass focusing effect and linear jet can be produced along the dividing plane between two omni-directional MWBs or two Alford Bottler disrupters placed side-by-side. In this case, the explosive charges are in separate containers. There is poor shock communication between the charges, and thus almost no Mach stem effect is observed. The convergence of the radially expanding water generated by each disrupter causes the water density and velocity to be slightly higher in the plane at the junction of the two disrupters. The water jets interact. In contrast, the FLExCAT uses shock coupling and the Mach stem effect to produce the single water jet.

Alternatively, rather than profiling the container to achieve a desired curvature, the multi-sided FLExCAT can use parabolically shaped internal air bladders or low density closed cell foam to displace the water inside of a rectangular shaped container. The advantage of this approach is reduced costs and will make field fabrication feasible. Accordingly, "wall curvature" is used broadly herein to include a curvature of the wall itself and/or another component, such as an air bladder or foam material, positioned between an inner surface of the wall that faces the container volume and the liquid positioned in the container volume. In this manner, to an outside observer, the walls of the container may appear flat, but the use of another shaped component adjacent to an inner-facing surface of the container in effect provides the curved walls.

Simultaneous initiation of the explosive cores can be accomplished in multiple ways. In one embodiment, the charges are center-initiated at a single point or region rather than initiated at the top or bottom. Initiating the stems from either end causes the water jet to form with a Taylor projection angle. Top initiation will cause the jet to have a slower velocity near the point of initiation and a higher velocity at the bottom as the detonation velocity increases until it reaches steady-state. The effect is that the fluid moves at a downward angle and the liquid at the bottom jets ahead of the liquid at the top. Two-point initiation of the stems at the top and bottom results in a jet that is pyramidal in shape. The jet tip narrows with distance and focuses to a point. The two initiation points can be positioned midway between the charge ends and its center. This initiation point configuration results in a jet that has a slightly higher velocity in the center of the jet front and the jet edge has a convex profile when viewed from the side. Three-point initiation or higher produces a linear jet tip. In this manner, the FLExCAT may relate to initiation of one or more of initiation points between a detonator and the explosives in the container volume, each located at a specific contact point or region, so as to achieve a desired cross-sectional jet shape.

Rather than using multiple detonators positioned at each of the initiation points, a single detonator can be used to initiate an explosives guide constructed of Primasheet strips that define path(s) for transmitting detonation waves. Primasheet is being used to describe the function of an explosives guide and is an example type of explosive. There are many types of explosives that can be used to form an explosives path. The Primasheet strips can be of equal length or differing length, can have multiple branch points, and take linear or curved paths to the initiation points on the geometrically-shaped-charges. The Primasheet strips bridge the two or more main charges and as such the different guides can be referred to hereafter as explosive bridges. Precise timing of initiation at one or more points on the main charges is accomplished. The initiation of the charges or the points on a given charge can be simultaneous or asynchronous. The incident angle of the Primasheet bridge at the explosive charge junction can also control the detonation wave direction(s) and distance to steady state propagation. The contact position on the main charge can also affect detonation wave propagation, direction, and velocity. Explosive bridge mating with the proximal side of the main charges results in a higher jet tip velocity compared to the same explosive bridge that initiates on the inside surface of the main charges. The angle of the bridge path relative to the charge face can also affect detonation velocity and jet stability. A normal interface compared to an incident angle of 45 degrees, 30 degrees, or 20 degrees will have higher jet tip velocity, but the shallower angles have been shown in CTH simulations to produce more stable liquid jets. This control of explosive core initiation is yet another means of independent control of a liquid jet parameter.

Similarly, the jet shape can be independently changed by applying curvature to the surface parallel to the central axis of the charge. The axial profile is similar to an hour-glass and this geometry causes the jet to focus. The linear jet is narrower in height; however, the penetration performance is similar to an axisymmetric charge due to a longer jet length.

Shock collisions are the interference of shockwaves which are produced by each explosive charge being incident within a plane. To produce maximum pressure to drive the water and form a symmetrically shaped water jet along the charge central plane, the detonation simultaneity of the charges can be important. A detonator can be placed at the center of each charge. The two or more detonators must be initiated at the same time. Electric detonators cannot be used due to their jitter time. The non-electric detonator's shock tube length must be cut precisely and then a 'T' junction, a three-way, or a four-way shocktube splitter junction is connected to a trunk line. Alternatively, a single detonator can be used in combination with an explosive guide to initiate two or more charges (described above). We have measured the difference in time between two separated charges initiated by two Nonel detonators connected by a shock tube junction and have shown that the isochronicity is poor compared to single detonator initiating an explosive guide at its center. In the latter case, the detonation wave travels in two opposing directions and initiates the explosive stems nearly simultaneously. Branched detonation cord is a common method to simultaneously initiate two or more charges. The detonator is placed in the pocket formed by two pieces of detonation cord placed side-by-side and the cord lines split a distance from the initiation point. For the most precise isochronicity, an explosive guide (also referred herein as a "holder") that has a channel to fill with PETN-based Primasheet explosive is used. Due to the small critical diameter of PETN, the explosive strips that are placed in the channels can be as narrow as 1 mm. For practical field application, a 0.25" wide strip of sheet explosive is bridged between the two explosive cores. A single detonator is placed at the center of the strip. Initiation of the detonator results in two detonation waves traveling away from the initiation point to initiate the cuboidal bars. A Primasheet booster is adjacent to the composition C-4 bars and causes the explosive charges to detonate. The guide can be complex and can have a trunk with multiple bifurcations in order to initiate both charges at two or more points simultaneously.

STATEMENTS REGARDING INCORPORATION BY REFERENCE AND VARIATIONS

All references throughout this application, for example patent documents including issued or granted patents or equivalents; patent application publications; and non-patent literature documents or other source material; are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments, exemplary embodiments and optional features, modification and variation of the concepts herein disclosed may be resorted to by those skilled in the art, and that such modifications and variations are considered to be within the scope of this invention as defined by the appended claims. The specific embodiments provided herein are examples of useful embodiments of the present invention and it will be apparent to one skilled in the art that the present invention may be carried out using a large number of variations of the devices, device components, methods steps set forth in the present description. As will be obvious to one of skill in the art, methods and devices useful for the present methods can include a large number of optional composition and processing elements and steps.

As used herein and in the appended claims, the singular forms "a", "an", and "the" include plural reference unless the context clearly dictates otherwise. Thus, for example, reference to "a cell" includes a plurality of such cells and equivalents thereof known to those skilled in the art. As well, the terms "a" (or "an"), "one or more" and "at least one" can be used interchangeably herein. It is also to be noted that the terms "comprising", "including", and "having" can be used interchangeably. The expression "of any of claims XX-YY" (wherein XX and YY refer to claim numbers) is intended to provide a multiple dependent claim in the alternative form, and in some embodiments is interchangeable with the expression "as in any one of claims XX-YY."

When a group of substituents is disclosed herein, it is understood that all individual members of that group and all subgroups, are disclosed separately. When a Markush group or other grouping is used herein, all individual members of the group and all combinations and subcombinations possible of the group are intended to be individually included in the disclosure.

Every device, system, formulation, combination of components, or method described or exemplified herein can be used to practice the invention, unless otherwise stated.

Whenever a range is given in the specification, for example, a temperature range, a time range, or a composition or concentration range, all intermediate ranges and subranges, as well as all individual values included in the ranges given are intended to be included in the disclosure. It will be understood that any subranges or individual values in a range or subrange that are included in the description herein can be excluded from the claims herein.

All patents and publications mentioned in the specification are indicative of the levels of skill of those skilled in the art to which the invention pertains. References cited herein are incorporated by reference herein in their entirety to indicate the state of the art as of their publication or filing date and it is intended that this information can be employed herein, if needed, to exclude specific embodiments that are in the prior art. For example, when composition of matter are claimed, it should be understood that compounds known and available in the art prior to Applicant's invention, including compounds for which an enabling disclosure is provided in the references cited herein, are not intended to be included in the composition of matter claims herein.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" may be replaced with either of the other two terms. The invention illustratively described herein suitably may be practiced in the absence of any element or elements, limitation or limitations which is not specifically disclosed herein.

One of ordinary skill in the art will appreciate that starting materials, biological materials, reagents, synthetic methods, purification methods, analytical methods, assay methods, and biological methods other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

We claim:

1. A shaped-charge comprising:

a container having a plurality of curved walls, a top surface, and a bottom surface to form a container volume for containing a liquid, the container having a symmetry plane;

the liquid positioned in the container volume;

at least one explosive charge positioned in the container volume and immersed in the liquid, wherein at least one explosive charge is a geometrically-shaped-charge or is contained within a shell volume formed by shell walls;

a detonator channel for receiving an explosive firing train to controllably detonate the at least one explosive charge;

wherein the container walls, the at least one explosive charge and liquid are configured to provide a wedge-shaped liquid jet or a liquid jet having a circular cross-section upon detonation of the at least one explosive charge immersed in the liquid contained in the container volume;

wherein at least one of the plurality of curved walls has a catenary profile, a parabolic profile, or a circular arc profile; and the plurality of curved walls comprising: a distal surface, a proximal surface, a first sidewall, and a second sidewall, wherein the first and second sidewalls are opposed surfaces that connect the distal and proximal surfaces to form the container volume, wherein the first and second sidewalls have a curvature that is different from a curvature of the distal and proximal surfaces.

2. The shaped-charge of claim 1, wherein the curved profile extends from the bottom surface to the top surface, wherein at least one of the plurality of curved walls has the parabolic profile that is uniform along an axial direction extending from the bottom surface to the top surface.

3. The shaped-charge of claim 1, further comprising an apex region positioned between adjacent curved walls, wherein the apex region has a different geometrical shape than the curved walls.

4. The shaped-charge of claim 1, wherein the at least one explosive charge comprises a geometrically-shaped-charge, wherein for a plurality of shaped-charges the shaped-charges form a linear or a triangular shape relative to each other.

5. The shaped-charge of claim 4, wherein the geometrically-shaped-charge has a volume defined by a cuboidal shape; a cylindrical shape; a rhomboidal shape; an ellipsoid shape; or a shelled surface that is planar or curved.

6. The shaped-charge of claim 4, wherein the geometrically-shaped-charge extends between a first end and a second end, wherein the geometrically-shaped-charge has an axial-dependent cross-sectional area that decreases from a center point toward each of the first end and the second end.

7. The shaped-charge of claim 1, further comprising:

an explosives holder configured to hold the at least one explosive charge and controllably position the explosive charges in the container volume for multi-point initiation; wherein the explosives holder comprises a longitudinal positioner to variably position the explosive charges in a longitudinal position and/or a lateral positioner to position the explosive charges in a lateral position within the container volume.

8. The shaped-charge of claim 1, further comprising a surface material attenuation of rarefaction shock waves (SMART) material positioned on one or more outer surface of the container, including portions thereof.

9. The shaped-charge of claim 1, wherein at least one of the curved walls is formed by:

an insert having a curvature positioned against an inner surface of the container, wherein the insert is selected from the group consisting of:

a bladder;

a SMART material; and a shaped rigid material, such that the liquid in contact with the insert has a curved surface, or at least one of the curved walls comprises the SMART material.

10. The shaped-charge claim 1, further comprising a notch in at least a portion of the distal surface.

11. A method for producing a liquid jet, the method comprising the steps of:

providing the shaped-charge of claim 1;

aligning the distal surface with a target;

detonating the at least one explosive charge to produce the liquid jet, wherein the liquid jet moves in a direction from the shaped-charge toward the target.

12. The method of claim 11, wherein the at least one explosive charge comprises two or three geometrically-shaped explosive charges, the method further comprising the steps of:

positioning the two or three geometrically-shaped explosive charges in an adjustable explosive charges holder;

inserting the adjustable explosive charges holder holding the two or three geometrically-shaped explosives in the container volume; and adjusting with the adjustable explosives charges holder to controllably position the geometrically-shaped explosives charges with respect to a separation distance from the distal surface.

13. The method of claim 12, further comprising the step of adjusting one or more of:

a curvature of at least one of the plurality of shaped surfaces;

a position of an explosive charge in the container volume;

a number of the explosives charges;

a SMART material positioned on an outer surface of the container;

an air gap in the container volume; and/or a liquid composition;

to thereby control a fluid jet characteristic.

14. A shaped-charge comprising:

a container having a plurality of curved walls, a top surface, and a bottom surface to form a container volume for containing a liquid, the container having a symmetry plane;

the liquid positioned in the container volume;

at least one explosive charge positioned in the container volume and immersed in the liquid, wherein at least one explosive charge is a geometrically-shaped-charge or is contained within a shell volume formed by shell walls;

a detonator channel for receiving an explosive firing train to controllably detonate the at least one explosive charge;

wherein the container walls, the at least one explosive charge and liquid are configured to provide a wedge-shaped liquid jet or a liquid jet having a circular cross-section upon detonation of the at least one explosive charge immersed in the liquid contained in the container volume;

wherein at least one of the plurality of curved walls has a parabolic profile; and where the parabolic profile is a biaxial profile having a parabolic curvature along each of an axial direction and a radial direction relative to a container center-line.

15. A shaped-charge comprising:

a container having a plurality of curved walls, a top surface, and a bottom surface to form a container volume for containing a liquid, the container having a symmetry plane;

the liquid positioned in the container volume;

at least one explosive charge positioned in the container volume and immersed in the liquid, wherein the at least one explosive charge is a geometrically-shaped-charge;

a detonator channel for receiving an explosive firing train to controllably detonate the at least one explosive charge;

wherein the container walls, the at least one explosive charge and liquid are configured to provide a wedge-shaped liquid jet or a liquid jet having a circular cross-section upon detonation of the one or more explosive charges immersed in the liquid contained in the container volume;

wherein the at least one explosive charge comprises one or more geometrically-shaped-charges, including one, two or three geometrically-shaped-charges, wherein for a plurality of geometrically-shaped-charges the geometrically-shaped-charges form a linear or a triangular shape relative to each other;

an explosives holder configured to support and position each of the geometrically-shaped-charges in the container volume, the explosive holder further comprising an explosives guide configured to support an explosive firing train;

the explosive firing train positioned in the explosives guide, wherein the explosive firing train comprises a flexible explosive sheet or detonation cord having one or more termination ends that contact the geometrically-shaped-charges; and wherein the explosives guide is shaped to provide controllable detonation of each of the geometrically-shaped-charges, including with an explosives guide length.

16. The shaped-charge of claim 15, wherein the explosives guide comprises branches that form multiple distinct contact points with the at least one geometrically-shaped-charges, wherein a position of each of the multiple distinct contact points is selected to control a liquid jet parameter based on one or more target characteristics, including a liquid jet parameter that is a liquid jet shape and/or a liquid jet velocity.

17. The shaped-charge of claim 16, wherein each of the multiple distinct contact points of the explosives guide on the geometrically-shaped-charges is at a proximal surface farthest from the target, an inside surface nearest the container volume center-line, or an outside surface nearest the sidewall surface or edge, configured to control the liquid jet parameter based on one or more target characteristics, wherein a relative angle ($\varphi$) defined by an explosives guide detonation wave direction to a surface at the contact point on the geometrically-shaped-charge can be adjusted from 0-90 degrees and is selected to control the liquid jet parameter based on one or more target characteristics.

18. The shaped-charge of claim 17, wherein the geometrically-shaped-charges comprise a sheet of explosives wrapped around a tubular cylindrical substrate having a central orifice filled with water or a rigid rod of a plastic or a high shock impedance material, optionally steel, copper, brass, or aluminum.

* * * * *